US006931719B2

(12) United States Patent
Itai et al.

(10) Patent No.: US 6,931,719 B2
(45) Date of Patent: Aug. 23, 2005

(54) INSULATION-DISPLACEMENT CONNECTOR CONNECTING APPARATUS AND METHOD

(75) Inventors: Toshi Itai, Yokkaichi (JP); Koji Fujita, Yokkaichi (JP); Kenji Hashimoto, Yokkaichi (JP); Junichi Shirakawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/950,030

(22) Filed: Sep. 10, 2001

(65) Prior Publication Data

US 2002/0055295 A1 May 9, 2002

(30) Foreign Application Priority Data

Sep. 11, 2000 (JP) ..... 2000-274879

(51) Int. Cl.[7] ..... H01R 43/00

(52) U.S. Cl. ..... 29/749; 29/748; 29/754; 29/758

(58) Field of Search ..... 29/747, 748, 749, 29/754, 755, 564.4, 566.3, 753, 33 M, 857, 866

(56) References Cited

U.S. PATENT DOCUMENTS 4,281,442 A * 8/1981 Senior et al.
4,584,757 A * 4/1986 Adlon et al.
4,754,536 A * 7/1988 Goyert et al.
4,870,752 A * 10/1989 Brown et al.
6,062,896 A 5/2000 Huang
6,163,958 A * 12/2000 Suzuki

FOREIGN PATENT DOCUMENTS

| | | |
|---|---|---|
| EP | 0 810 698 A2 | 12/1997 |
| EP | 0 833 417 A2 | 4/1998 |
| JP | 61-117465 | 6/1986 |
| JP | 6-188055 | 7/1994 |
| JP | 11-39967 | 11/1999 |

* cited by examiner

*Primary Examiner*—Carl J. Arbes
(74) *Attorney, Agent, or Firm*—Gerald E. Hespos; Anthony J. Casella

(57) ABSTRACT

An apparatus and method are provided to perform an insulation-displacement connecting operation and a cover mounting operation efficiently, and hence to improve a yield for insulation-displacement joint connectors having many contacts. The apparatus includes a press unit (200) with a slide unit (220) for carrying connection-assisting parts, such as a wire-checking device for checking a housing of an insulation-displacement joint connector, a wire pushing device and a cover holder. A wire checking operation, a wire pushing operation and a cover mounting operation are performed continuously by switching the slide unit (220) by means of a switching device (230) and successively driving the connection-assisting parts by means of one press (210).

13 Claims, 22 Drawing Sheets

INSULATION-DISPLACEMENT CONNECTOR CONNECTING APPARATUS AND METHOD

BACKGROUND OF THE INVENTION

1. Field of the Invention

The present invention relates to an insulation-displacement connector connecting apparatus and method.

2. Detailed Description of the Related Art

A wiring harness is an electrical wiring system with many wires. The wiring harness is assembled by laying wires on an assembling board and mounting electrical devices and wiring devices on the wires. The wiring devices of the wiring harness are likely to include insulation-displacement connectors.

A large wiring harness typically is made by first producing a plurality of unit wire assemblies called partially bundled circuits. The partially bundled circuits then are connected electrically by an insulation-displacement joint connector in a full bundling process, as shown, for example, in Japanese Unexamined Utility Model Publication No. 61-117465.

FIG. 1 is an exploded perspective view of an insulation-displacement joint connector 20 that can be connected by an apparatus according to the present invention. The insulation-displacement joint connector 20 has a resin cover 21, a housing 22, and an insulation-displacement terminal 23 made of an electrically conductive material. The cover 21 has a U-shaped lateral cross section and is integrally provided with a substantially rectangular top plate 21A, side plates 21B at the longer sides of the top plate 21A and end plates 21C at the shorter ends of the top plate 21A. Pushing pieces 21D extend down from the inner surface of the top plate 21A for pushing unillustrated wires into an insulation-displacement terminal 23.

The housing 22 has a substantially rectangular main body 22A that faces the top plate 21A of the cover 21, and holding pieces 22B, 22C stand in two lines along the longitudinal direction of the main body 22A. Temporary holding portions 202 or holding spaces D1 are defined by adjacent holding pieces 22B, 22C for temporarily holding branch wires that are to be connected with the insulation-displacement terminal 23. The housing 22 also has two lines of projections that are parallel to and between the groups of holding pieces 22B, 22C.

The insulation-displacement terminal 23 is mounted between the two groups of projections on the housing 22. The insulation-displacement terminal 23 is made of an electrically conductive plate material and is designed for electrical connection with the branch wires. More particularly, the insulation-displacement terminal 23 cuts open the insulation coating of the branch wires and then holds the cores of the branch wires.

Presses are used to electrically connect wires of a wiring harness to the insulation-displacement joint connector 20. One such press apparatus is disclosed in Japanese Patent Publication No. 2970273, which is assigned to the assignee of the present invention. The apparatus disclosed in Japanese Patent Publication No 2970273 requires the housing 22 of the insulation-displacement joint connector 20 to be positioned on a connector table on a wiring harness assembling board. An insulation-displacement press is coupled detachably with the connector table and suspended for vertical movement. The cover 21 of the insulation-displacement joint connector 20 is mounted in the insulation-displacement press and pressed down to push the wires into the insulation-displacement terminal 23 for connection and to mount the cover 21 on the housing 22. However, this construction cannot be applied to insulation-displacement joint connectors with many contacts because the connection of the wires by insulation displacement and mounting of the cover 21 on the housing 22 are performed solely by a pressing force of the insulation-displacement press.

Japanese Unexamined Patent Publication No. 11-039967 shows an apparatus for insulation-displacement joint connectors having many contacts. The apparatus requires a worker to operate a pushing press for pushing the wires mounted in the housing 22 into the insulation-displacement terminal 23 prior to pressing by the insulation-displacement press.

The above-described apparatus puts a large burden on the operator and causes poor operability due to the requirement for attaching and detaching the press for connecting the wires by insulation displacement followed by attaching and detaching the press for mounting the cover in order to connect one insulation-displacement joint connector.

In view of the above problems, an object of the present invention is to provide an insulation-displacement connector connecting apparatus and an efficient method to perform a connecting operation by insulation displacement and a cover mounting operation for insulation-displacement connectors having many contacts.

SUMMARY OF THE INVENTION

The invention is directed to an apparatus for connecting an insulation-displacement terminal of an insulation-displacement connector to a plurality of wires on an assembling board. The connector includes a housing for receiving the insulation-displacement terminal and a cover for mounting on the housing. The apparatus comprises a pressure-receiving table for receiving the housing of the insulation-displacement joint connector. The apparatus also comprises a wire pushing device for pushing the wires mounted in the housing on the pressure-receiving table into the insulation-displacement terminal mounted in the housing. The apparatus further comprises a cover holder for holding the cover of the insulation-displacement connector and for mounting the cover on the housing after the wires have been pushed into the insulation-displacement terminal. A drive controlling means is provided for controllably driving a press unit to press the wire pushing device and the cover holder.

The wire pushing device and the cover holder are driven successively by the same press unit. Thus, a wire pushing operation and a cover mounting operation can be performed automatically.

The press unit further comprises a wire-checking device for checking the wires before they are pushed by the wire-pushing device. The wire-checking device may be operative to determine if wires are crossed, laid one over the other or misaligned with respect to each other. Additionally, the drive controlling means comprises a discriminating portion for judging whether the wire is satisfactory when the wire-checking device of the press unit is driven. The drive control means permits the press unit to drive the wire-pushing device and the cover holder if the discriminating portion judges the wires to be satisfactory and hinders the operation of the press unit if the wires are deemed unsatisfactory. Thus, errors can be prevented.

The pressure-receiving table preferably is movable with respect to a casing of the press unit between a mounting position where the wires can be mounted and detached and a pressure-receiving position where the pressure-receiving table receives pressure from the press unit. Thus, there is no danger of inadvertently striking the housing of the connector against a member of the press unit when the pressure-receiving table and the press unit are positioned with respect to each other, as compared to a case where the pressure-receiving table is on the assembling board for the wiring harness. Further, the ability to move the pressure-receiving table between the mounting position and the pressure-receiving position facilitates mounting the housing on the pressure-receiving table and placing the wires in the mounted housing.

The press unit preferably comprises a press for performing a pressing operation. The press preferably is substantially right above the pressure-receiving table. The press unit also comprises a reciprocally movable unit that moves within a range of a specified stroke for carrying the connection-assisting parts. A switching device is provided for setting the respective connection-assisting parts at a pressing position in the press via the reciprocally movable unit in an order of the wire pushing device and the cover holder. The press unit further comprises a transmitting means for transmitting a driving force of the press to the connection-assisting part at the pressing position. Such a press unit can be constructed inexpensively because a plurality of operation steps can be performed using the same press.

The reciprocally movable unit preferably comprises a shank that is detachably mountable on a shank holder of the press, and an elevatable block for each of the connection-assisting parts. The elevatable blocks are individually movable towards and away from the pressure-receiving table, preferably substantially upward and downward. With such a reciprocally movable unit, it is possible to individually change settings for the elevatable blocks for each of the connection-assisting parts and to set suitable elevation conditions or pressing conditions for each connection-assisting part.

The reciprocally movable unit preferably comprises an elevatable plate to integrally or unitarily carry the respective connection-assisting parts. The reciprocally movable unit is driven directly by the press towards and away from the pressure-receiving table, preferably substantially upward and downward. Such a reciprocally movable unit can have a simplified construction. Further, since the respective connection-assisting parts are directly mounted on the elevatable plate, the pressing operation can be performed by a relatively small press.

The press unit preferably is coupled releasably to the pressure-receiving table fixedly mounted on the wire assembling board by means of coupling means.

Most preferably, the pressure-receiving table and the press unit are positioned with respect to each other by means of at least one pin provided on one of the pressure-receiving table and the press unit and by a corresponding recess provided on the other of the pressure-receiving table and the press unit.

The invention also is directed to a method for connecting wires to an insulation-displacement terminal of an insulation-displacement connector. The connector comprises a housing for receiving the insulation-displacement terminal and a cover to be mounted on the housing. The method comprises positioning the housing of the insulation-displacement connector on a pressure-receiving table, pressing the wires into connection with the insulation-displacement terminal by means of a wire pushing device, and subsequently mounting the cover on the housing with a cover holder after the wires have been pushed into the insulation-displacement terminal.

The method may further comprise the step of checking the wires before they are pushed by the wire-pushing device. The checking step is carried out to judge whether a state of the wires is satisfactory. The wire-pushing device and the cover holder are operated if it is judged that the state of the wires is satisfactory. However, the wire-pushing device and the cover holder are hindered from operation if it judged that the state of the wires is unsatisfactory.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENT

Figure 2:
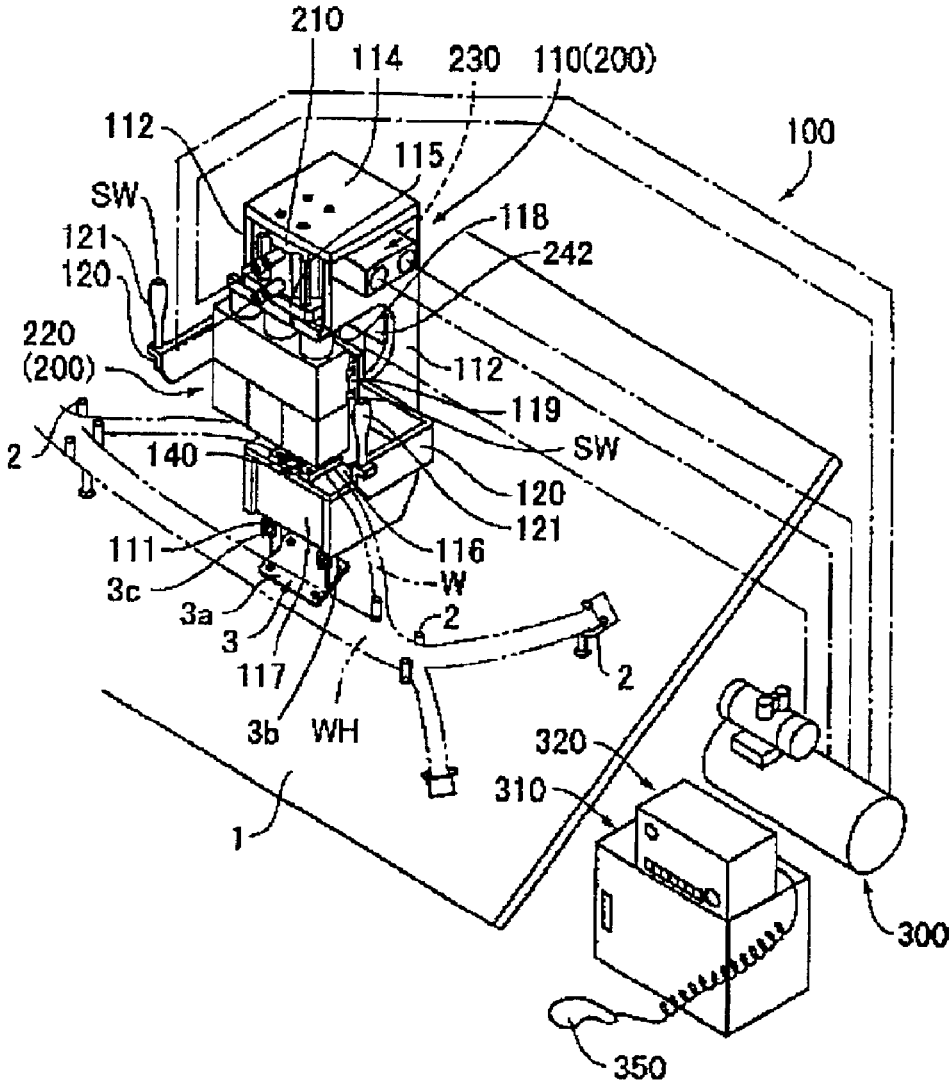
FIG. 2 is a perspective view of the connector connecting apparatus according to one preferred embodiment of the invention.

A connecting apparatus in accordance with the invention is identified by the numeral 100 in FIG. 2. The connecting apparatus 100 includes a press unit 200, a pressure intensifying tank 300 for driving the press unit 200, a control box 310 and an operation box 320. The press unit 200 is suspended by a suspension means above or near a conveyance line for endlessly conveying assembling boards 1 on which a wiring harness WH is assembled. The insulation-displacement joint connector 20 can be connected by the connecting apparatus 100 with branch wires of the wiring harness WH held on the assembly board 1 by U-shaped jigs 2.

The press unit 200 is positioned with respect to the wiring harness WH on the assembling board 1 by a locking device 3 that is mountable on the assembling board 1, as shown in FIG. 2. The locking device 3 includes a plate 3*a* secured on the assembling board 1 e.g. by screws and a pair of locking projections 3*b* that project from substantially opposite sides of the plate 3*a*. The locking projections 3*b* project substantially vertically on the inclined assembling board 1. The press unit 200 can be positioned by engaging hooks 3*c* atop the locking projections 3*b* with rings 111 mounted on the bottom surface of a casing 110.

The casing 110 of the press unit 200 is integrally or unitarily provided with a pair of side walls 112 with intermediate portions that are recessed in a complicated manner. A top plate 114 is provided on the upper ends of the side walls 112 and a shelf plate 115 is arranged below the top plate 114. A table 116 is mounted on upper edges of recessed portions of the side walls 112 at a location below the shelf plate 115, and an end plate 117 is below the table 116 in a position slightly retracted from the front ends of the side walls 112. An unillustrated bottom plate is provided at the bottom of the end plate 117, and the rings 111 are mounted on the bottom plate.

An unillustrated chain or suspension means is connected with the top plate 114, and the casing 110 is suspended from the ceiling by the chain.

An air cylinder 210, to be described later, is fixed to the shelf plate 115.

Figure 3:
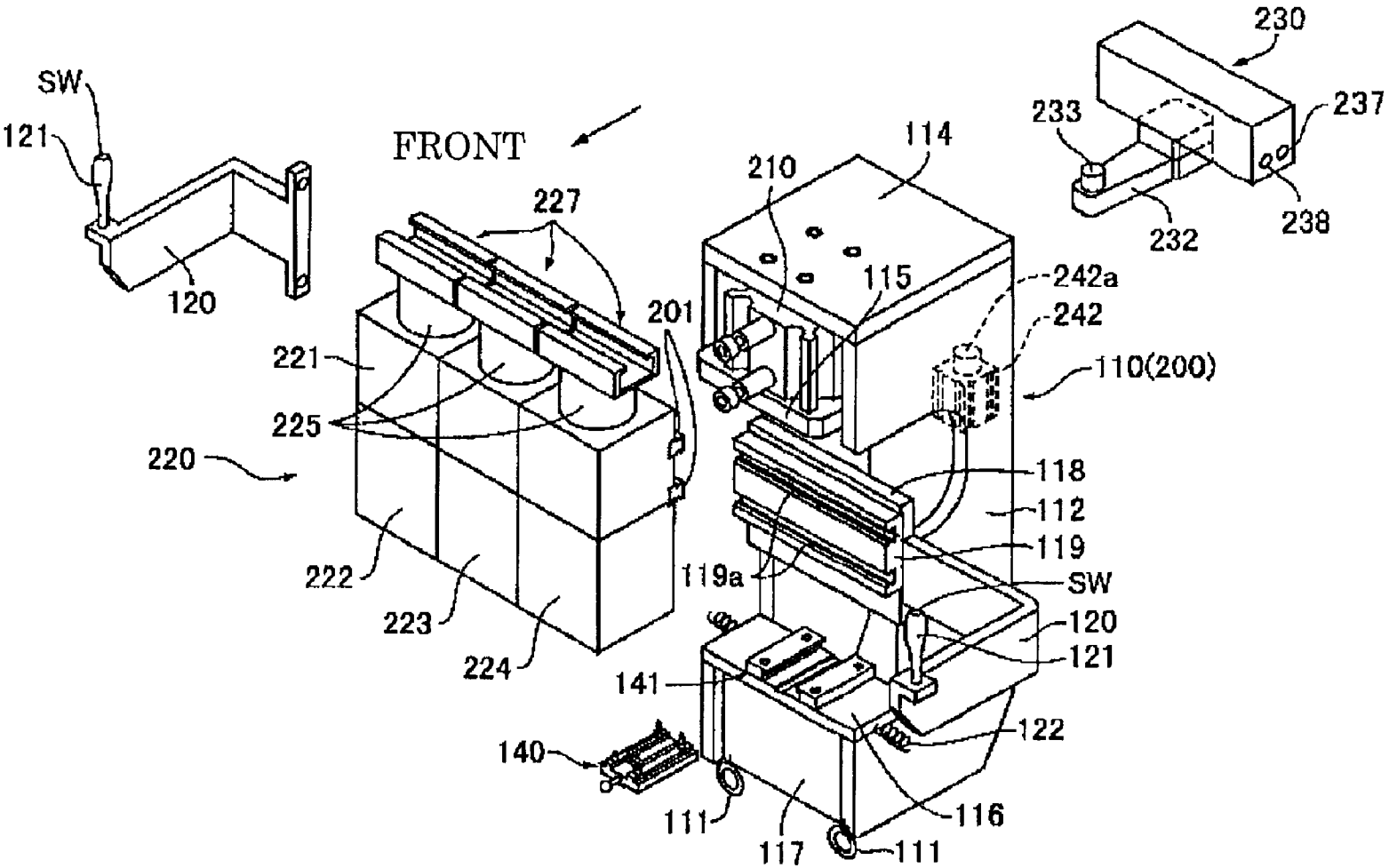
FIG. 3 is an exploded perspective view showing a portion of the connector connecting apparatus according to the embodiment of FIG. 2.

A mount plate 118 is fixed at the front of the recessed portions of the side walls 112, and an LM guide 119 is fixed to the front surface of the mount plate 118. The LM guide 119 has grooves 119*a* that engage guide rails 201 fixed to a slide unit 220 of the press unit 200, as shown in FIG. 3. Thus, the slide unit 220 is reciprocally movable in a transverse direction.

Left and right handle arms 120 are cantilevered from opposite sides of the mount plate 118, and grips 121 project from the free ends of the handle arms 120. Thus, an operator can move the connector connecting apparatus 100 by holding the respective grips 121. Push-button start switches SW are provided atop the grips 121 and are connected electrically with the operation box 320 to be described later. Though not specifically shown, a cover made e.g. of an acrylic resin is provided in a suitable position of the casing 110 to assure safety during the operation of the press unit 200.

Coil-shaped wire catchers 122 are mounted at opposite sides of the table 116, and branch wires W of the wiring harness WH can be held by the wire catchers 122 to extend along the upper surface of the table 116.

Figure 4:
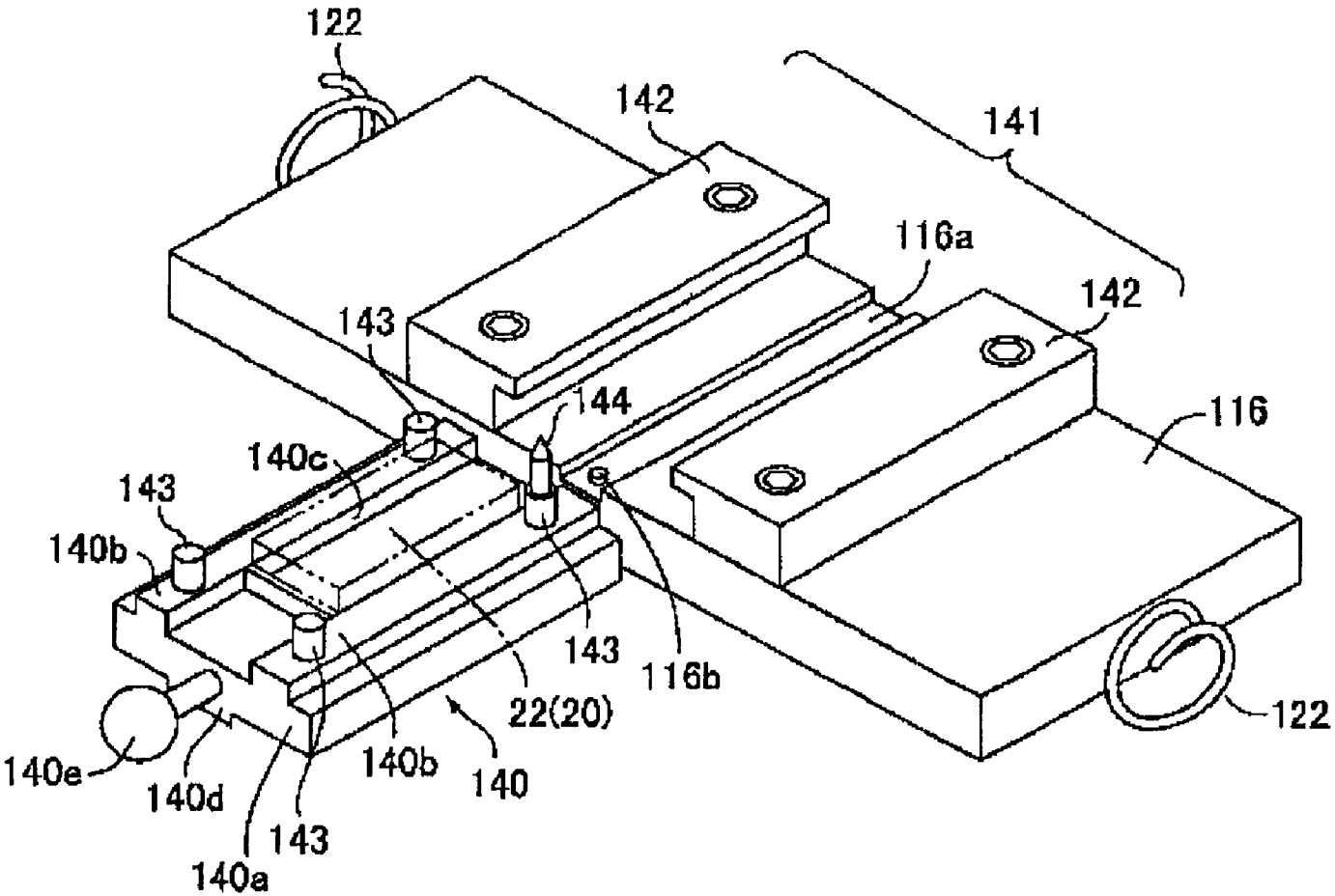
FIG. 4 is an exploded perspective view showing a portion of a casing according to the embodiment of FIG. 2.

A pressure-receiving table 140 is mounted in a slide guide 141 on the table 118 for receiving a housing 22 of the insulation-displacement joint connector 20. A groove 116*a* is formed substantially in the middle of the table 116 and extends along the longitudinal direction of the slide guide 141, as shown in FIG. 4. The slide guide 141 further includes guiding pieces 142 secured at opposite sides of the groove 116*a* by screws.

The pressure-receiving table 140 includes a base 140*a*, a pair of ribs 140*b* formed on the upper surface of the base 140*a*, and a connector accommodating portion 140*c* defined between the ribs 140*b*. The housing 22 of the insulation-displacement joint connector 20 can be positioned and held in the connector accommodating portion 140*c*.

A rib 140*d* is formed on the lower surface of the base 140*a*and corresponds to the groove 116*a* of the slide guide 141. Thus, the pressure-receiving table 140 can be guided for displacement in forward and backward directions by fitting the rib 140*d* into the groove 116*a*. Though not shown, a bottomed oblong hole is formed in the bottom surface of the rib 140*d*, and a stroke of the pressure-receiving table 140 in forward and backward or longitudinal directions can be restricted by a screw 116*b* in the groove 116*a*. Thus, the pressure-receiving table 140 is movable between a mounting position where it projects forward from the slide guide 141 and a pressure-receiving position where it is located within the slide guide 141. During a connecting operation, the pressure-receiving table 140 is displaced to the mounting position to mount or detach the branch wires W (see FIG. 2) on the assembling board 1 into or from the housing 22 of the insulation-displacement joint connector 20 in the connector accommodating portion 140*c*. The pressure-receiving table 140 then is displaced to the pressure-receiving position to enable a series of operations described later. Further, though not specifically shown, the table 116 has a limit switch or other such detection means. Thus, even if the start switch SW is operated, the press unit 200 cannot be actuated unless the pressure-receiving table 140 is at the pressure-receiving position. The screw 116*b* is located before the end plate 117 of the casing 110 so that a projecting amount can be adjusted below the table 116. Accordingly, the pressure-receiving table 140 can be detached from the table 116 during maintenance. In the FIG. 4 embodiment, a grip 140*e* projects from the front end of the pressure-receiving table 140 to facilitate the insertion and withdrawal of the pressure-receiving table 140, as described above.

With reference to FIG. 3, the press unit 200 includes the air cylinder 210, the slide unit 220 transversely displaceable by the LM guide 119 of the casing 110, and a switching cylinder 230 for reciprocally moving the slide unit 220 in transverse directions with respect to the positioned branch wires W.

Figure 7:
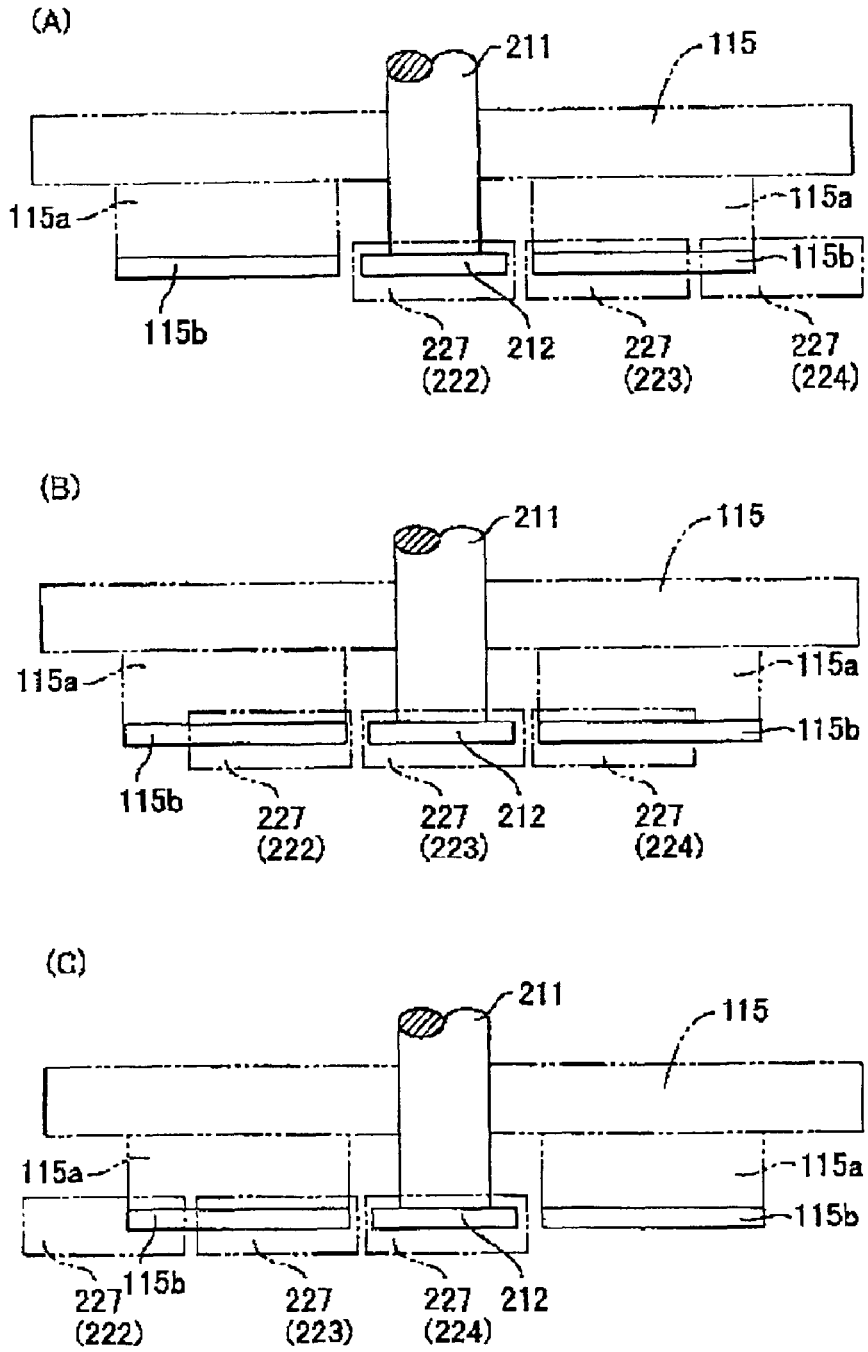
FIGS. 7(A), 7(B) and 7(C) are schematic front views showing a relationship between the slide unit and the casing according to the embodiment of FIG. 2 during a wire checking operation, during a wire pushing operation and during a cover mounting operation, respectively.

The air cylinder 210 is disposed in a pressing position directly above the pressure-receiving table 140. A rod 211 projects down from the air cylinder 210 and has a flange 212 fixed to its lower end, as shown in FIG. 7. Operation of the air cylinder 210 causes the rod 211 to move up or down relative to the pressure-receiving table 140.

The slide unit 220, as shown in FIGS. 5–9 has a hollow metallic slide block 221 in the form of a substantially rectangular parallelepiped that is elongated in the transverse direction. The guide rails 201 are mounted on the rear surface of the slide block 221 and are guided by the grooves 119*a* of the LM guide 119, as shown in FIG. 3.

Three hollow elevatable blocks 222, 223 and 224 in the form of rectangular parallelepipeds are provided below the slide block 221 for checking wires, for pressing the wires and for mounting a cover. Shanks 225 are fixed to the upper surfaces of the blocks 222–224 and are pierced through the slide block 221. The shanks 225 generate independent upward and downward movement of the respective blocks 222–224. Turn-stop pins 226 (only one is shown by hidden line in FIG. 6) project at four corners of the upper surface of each of the elevatable blocks 222–224, and are coupled to the slide block 221 to prevent rotation of the blocks 222–224 about the respective shanks 225.

The shank 225 of each elevatable block 222 to 224 has a channel-shaped coupling member 227, which includes a bottom plate 227*a*, opposed end plates 227*b* at the front and rear ends of the bottom plate 227, and top plates 227*c* that extend horizontally toward one another from the upper ends of the end plates 227*b*. The top plates 227*c* are spaced from one another and define a slit. The rod 211 of the air cylinder 210 is slid into the slit between the top plates 227*c* so that lower surfaces of the top plates 227*c* engage the flange 212 at the lower end of the rod 211, as shown in FIG. 7.

A pair of carrying stays 115*a* extend down from the shelf plate 115 of the casing 110 at the opposite sides of the air cylinder 210, as shown in FIGS. 7(A)–7(C). The stays 115*a* carry holding plates 115*b* that correspond to the configuration of the coupling members 227. The holding plates 115*b* hold the coupling members 227 that are not coupled with the flange 212 of the air cylinder 210, as shown in FIGS. 7(A) and 7(B). Thus, the shanks 225 and the corresponding elevatable blocks that are not coupled to the air cylinder 210 are prevented from descending.

Figure 5:
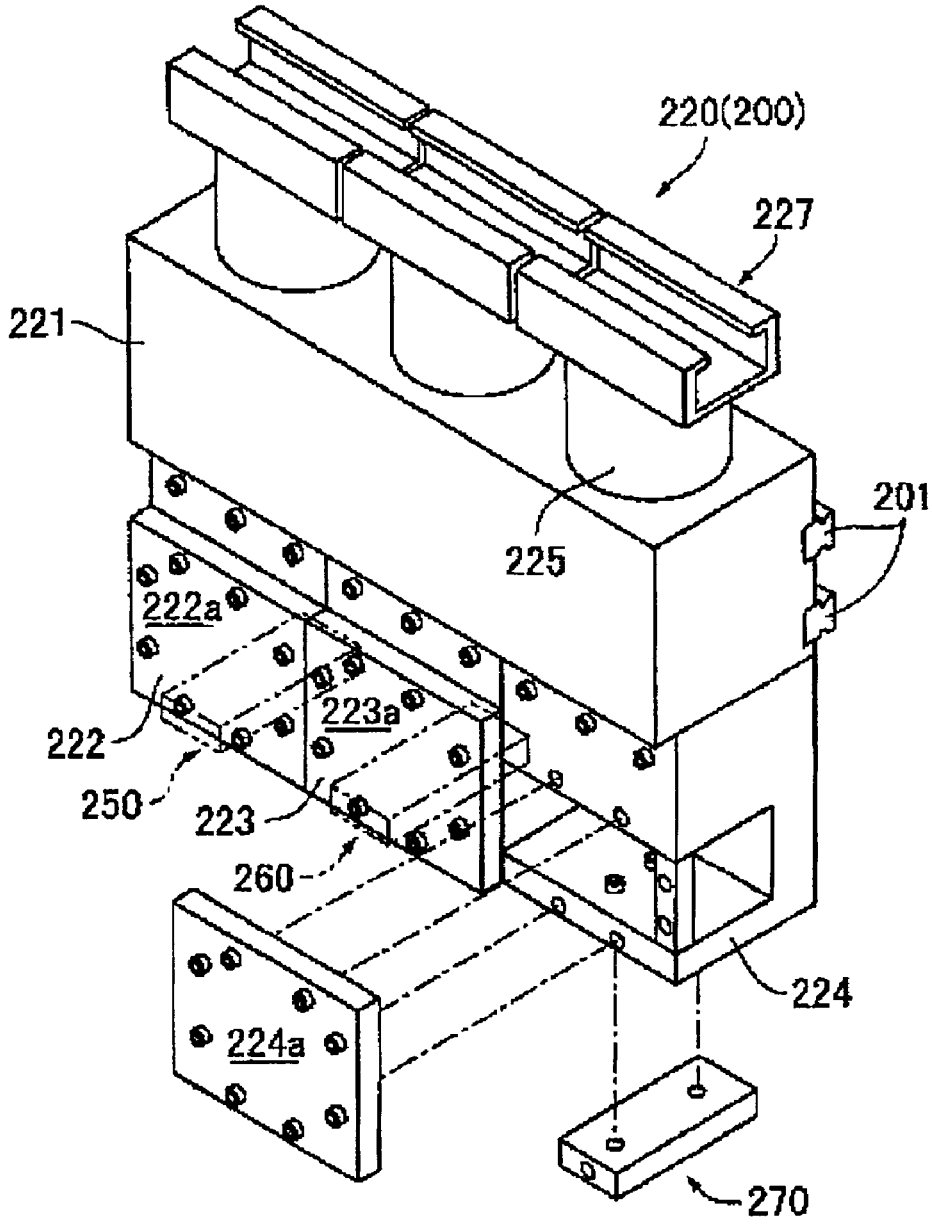
FIG. 5 is a partly exploded perspective view of a slide unit according to the embodiment of FIG. 2.
Figure 10:
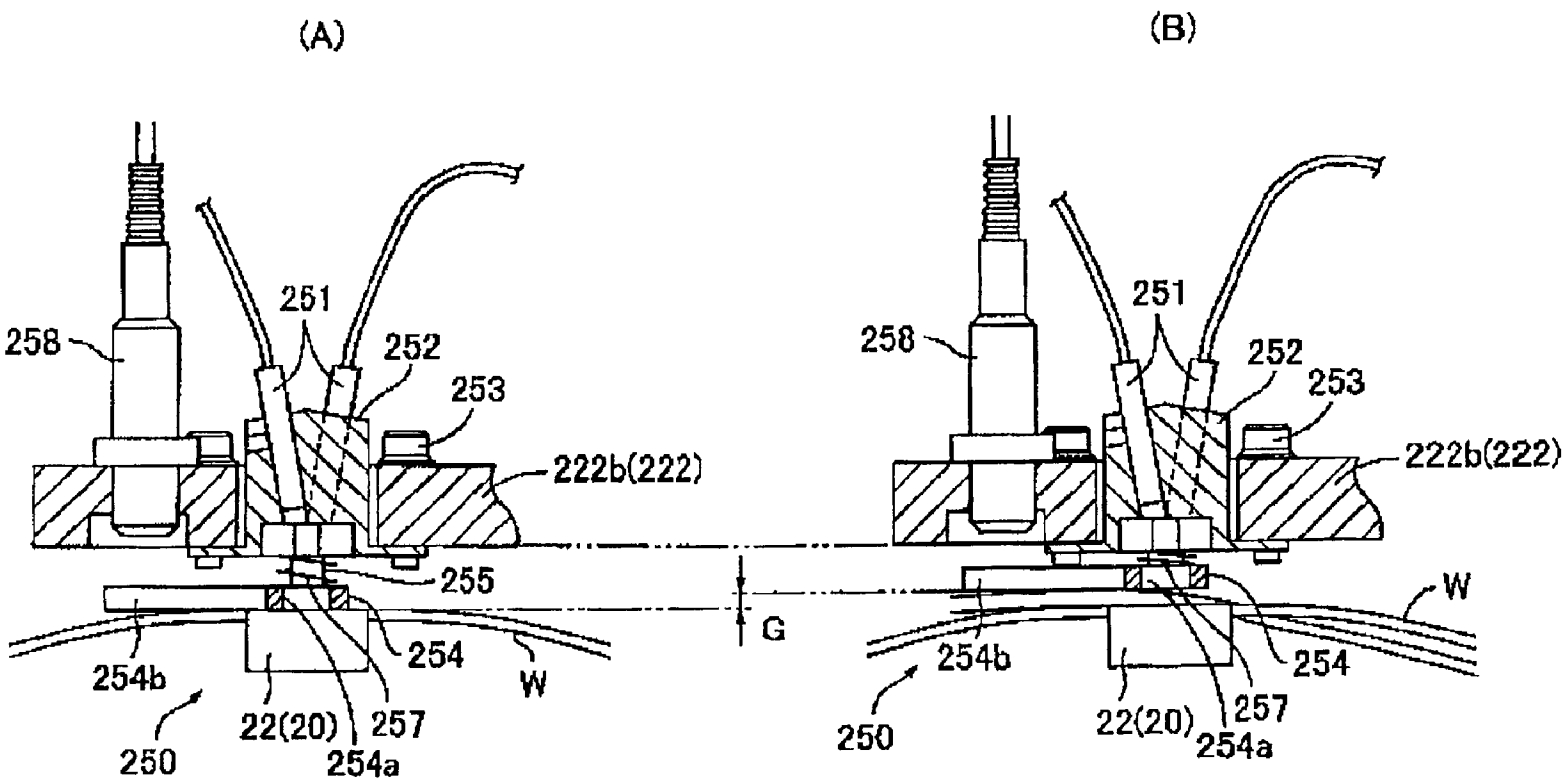
FIGS. 10(A) and 10(B) are schematic lateral sections showing a wire checking device as a connection-assisting part according to the embodiment of FIG. 2 at the time of checking a good product and at the time of a defective product.
Figure 11:
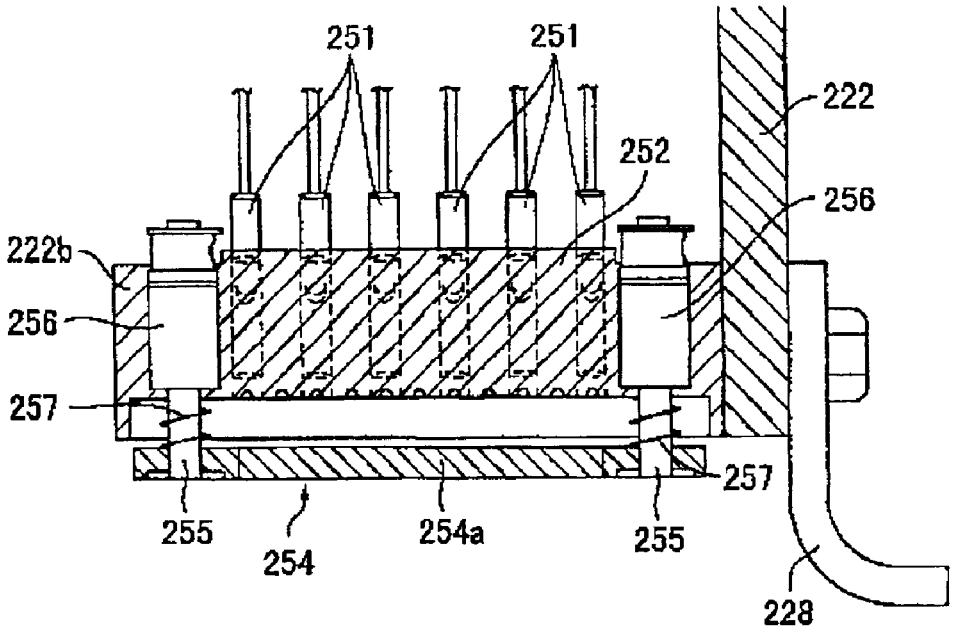
FIG. 11 is a schematic longitudinal section of the wire checking device of FIG. 10.
Figure 12:
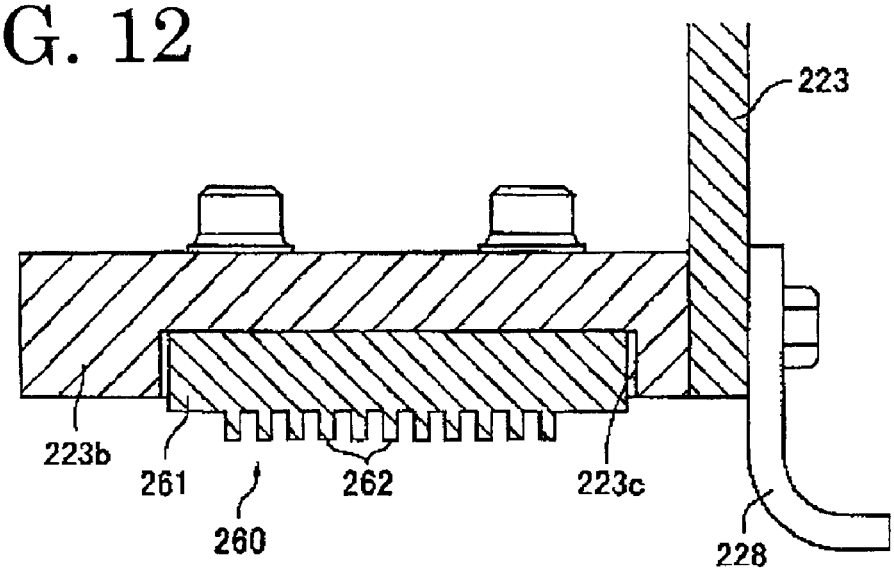
FIG. 12 is a schematic section of a wire pushing device as the connection-assisting part according to the embodiment of FIG. 2.
Figure 13:
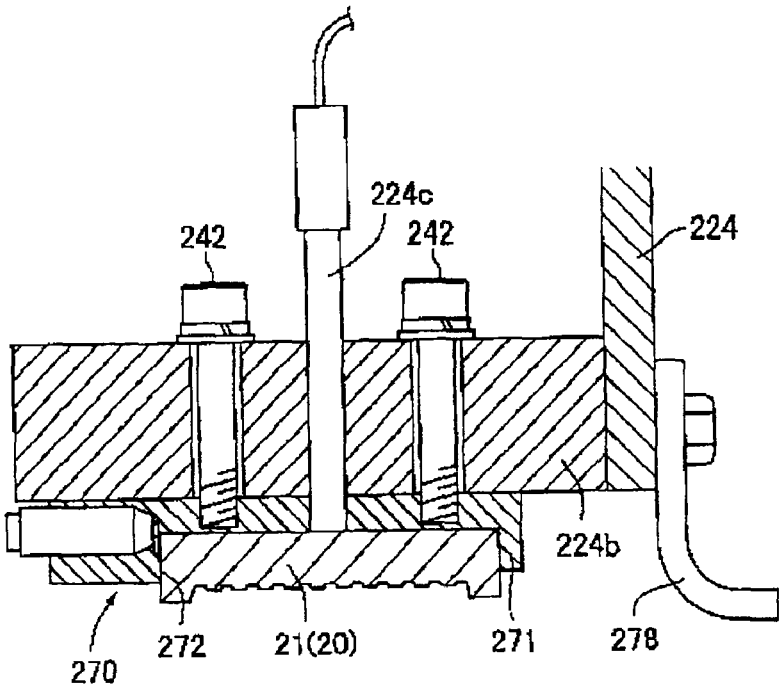
FIG. 13 is a schematic section of a cover holder as the connection-assisting part according to the embodiment of FIG. 2.
Figure 14:
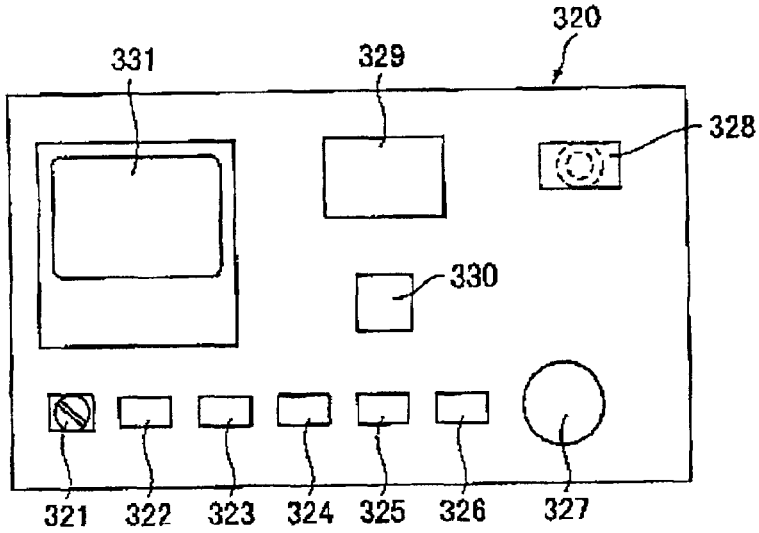
FIG. 14 is a schematic front view of an operation box according to the embodiment of FIG. 2.

The end plates 222*a* to 224*a* are mounted detachably by screws, as shown in FIG. 5, so that the inside of the respective elevatable blocks 222–224 can be exposed. Connection-assisting parts used to connect the insulation-displacement joint connector 20 (see FIG. 3) can be mounted on the respective elevatable blocks 222 to 224. The connection-assisting parts include: a wire checking device 250 in the elevatable block 222, as shown in FIGS. 10 and 11; a wire pushing device 260 in the elevatable block 223, as shown in FIG. 12; and a cover holder 270 in the elevatable block 224, as shown in FIG. 13.

Figure 6:
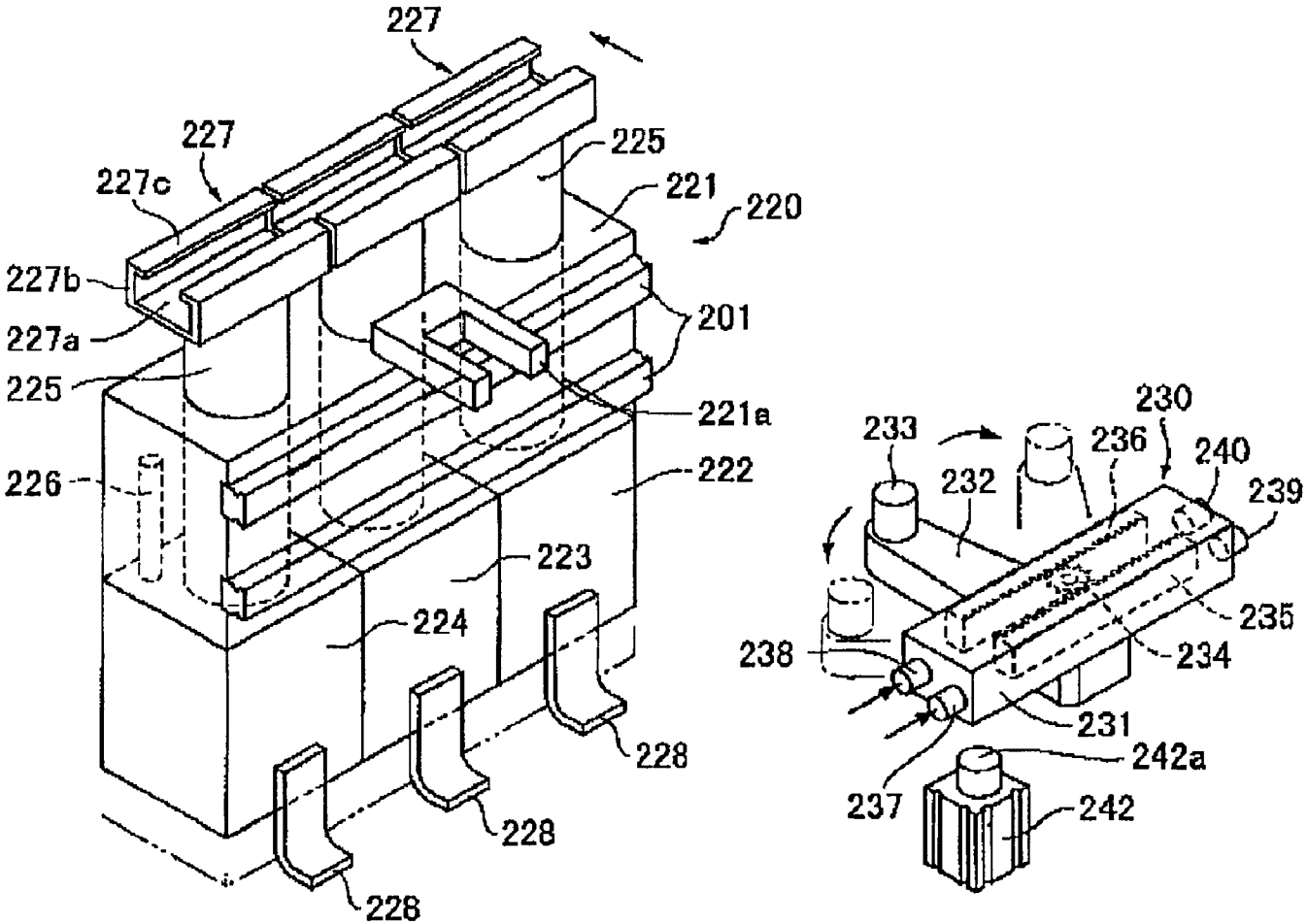
FIG. 6 is a perspective view showing a driving construction of the slide a unit according to the embodiment of FIG. 2.
Figure 8:
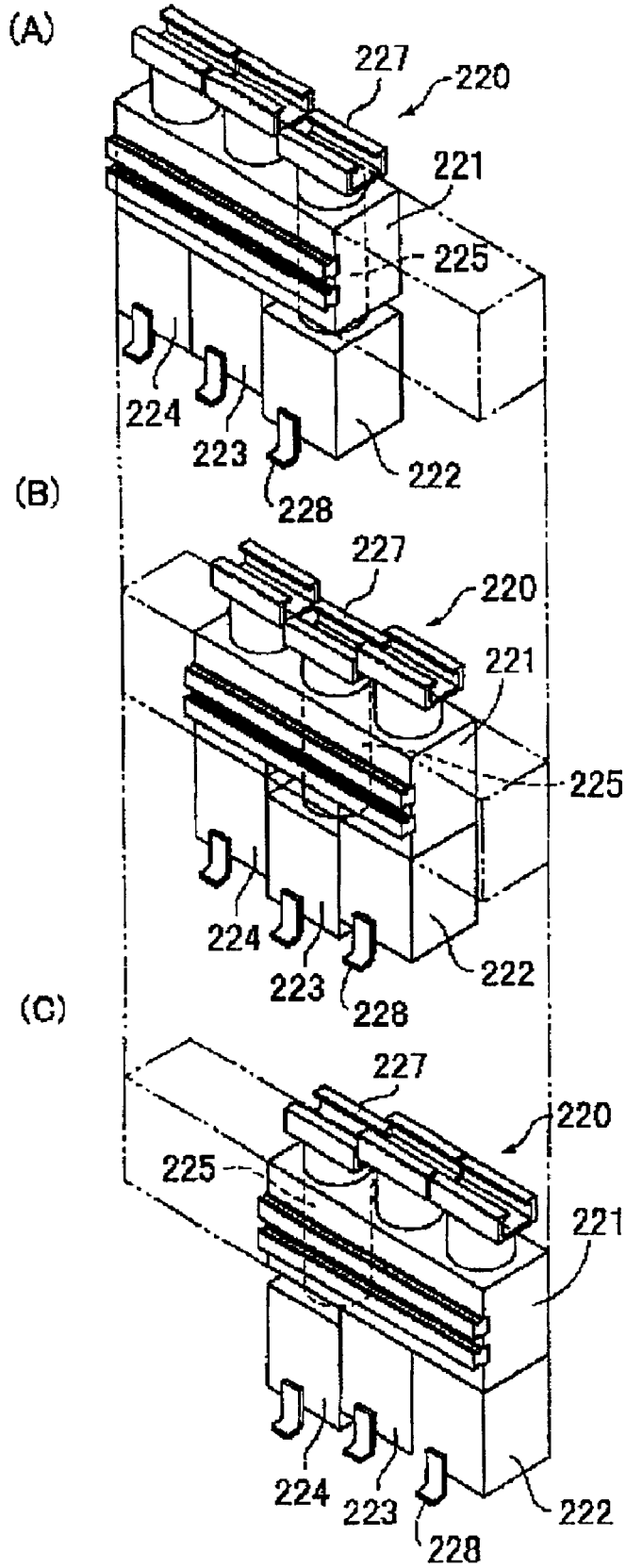
FIGS. 8(A), 8(B) and 8(C) are perspective views showing displaced states of the slide unit according to the embodiment of FIG. 2 during the wire checking operation, during the wire pushing operation and during the cover mounting operation, respectively.
Figure 9:
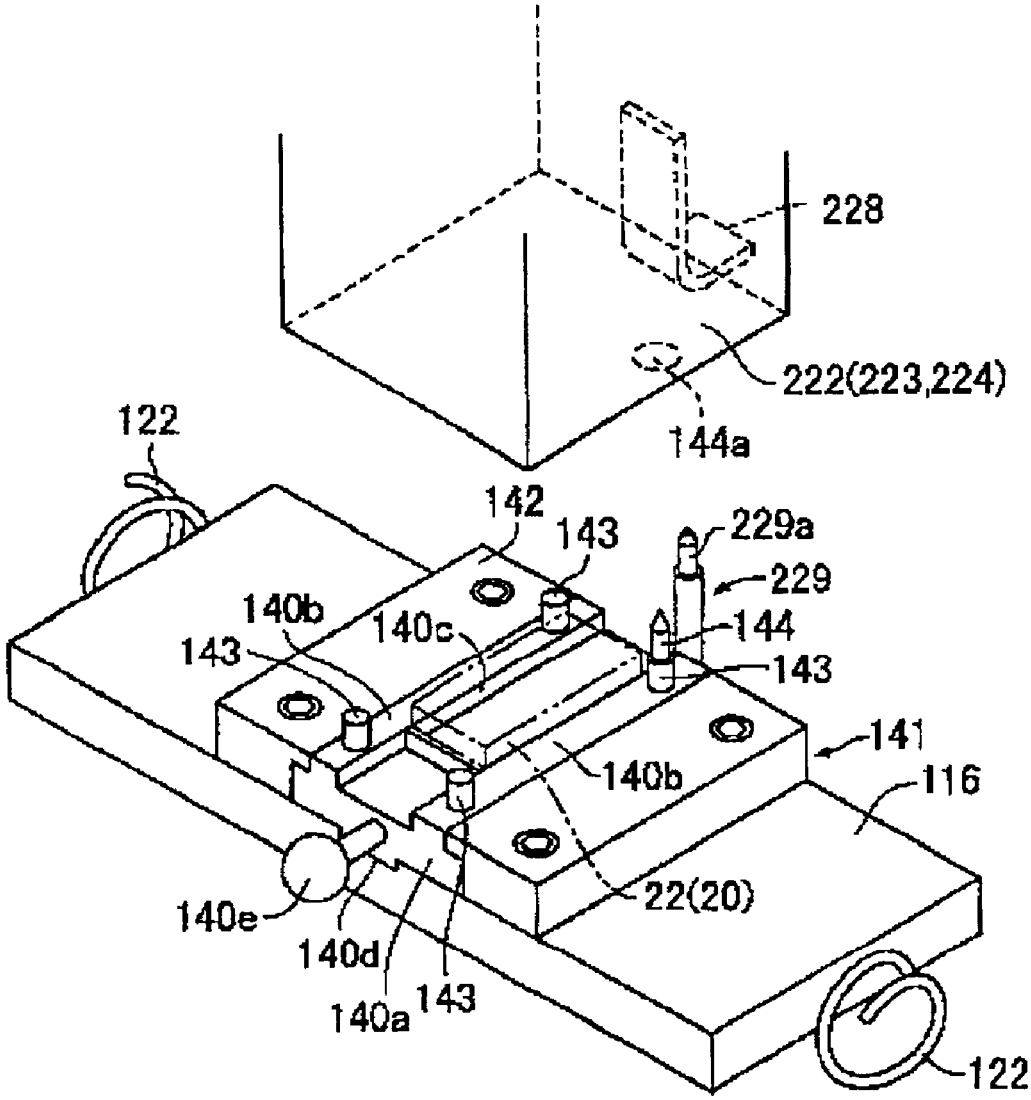
FIG. 9 is an enlarged perspective view showing a relationship between the slide unit and a pressure-receiving table according to the embodiment of FIG. 2.

Gauge dogs 228 are secured to the rear surfaces of the elevatable blocks 222 to 224, as shown in FIGS. 6, 8 and 9. The gauge dogs 228 depress a switch 229*a* of a lower-limit sensor 229 mounted at the rear side of the table 116 of the casing 110 to generate a signal that controls the stroke of the air cylinder 210. Further, stopper pins 143 stand on the respective ribs 140*b* of the pressure-receiving table 140. The stopper pins 143 receive the descending elevatable block 222–224 and ensure that the connection-assisting part (or a cover 21) in the elevatable block 222 to 224 is pressed against the housing 22 of the insulation-displacement joint connector 20 at a uniform pressure.

A positioning pin 144 with a smaller diameter than the stopper pins 143 projects substantially concentrically from at least one stopper pin 143, and a positioning hole 144*a* corresponding to the positioning pin 144 is formed in the bottom surface of each elevatable block 222–224. Thus, the housing 22 of the insulation-displacement joint connector 20 held on the pressure-receiving table 140 and the connection-assisting parts 250–270 mounted on the respective elevatable blocks 222–224 can be positioned precisely with respect to each other. The projective shape of the positioning pin 144 also prevents the wires are from getting jammed when the pressure-receiving table 140 and the elevatable block 222–224 are positioned.

The switching cylinder 230, as shown in FIG. 6, is provided to slide the respective elevatable blocks 222–224 by driving the slide unit 220 transversely with respect to the pressure-receiving table 140 or longitudinally with respect to the branch wires W. The switching cylinder 230 includes a main body 231 installed at a rear part of the casing 110, a pivot arm 232 mounted below the main body 231, and a cam roller 233 mounted on the upper surface of the free end of the pivot arm 232.

A pinion gear 234 is provided inside the main body 231 and is integrally or unitarily provided on the pivot arm 232 at a location concentric with the center of rotation of the pivot arm 232. Two rack gears 235, 236 are arranged symmetrically at opposite sides of the pinion gear 234, and air nozzles 237, 238 are mounted at one shorter end of the main body 231 to correspond to the respective rack gears 235, 236. The pinion gear 234 is rotated by selectively driving one rack gear 235 or 236 by either one of the air nozzles 237 or 238, thereby causing the pivot arm 232 coupled with the pinion gear 234 to pivot to the right or left. On the other hand, a forked link 221*a* is coupled with the cam roller 233 of the pivot arm 232 and is secured to the slide block 221 of the slide unit 220. The slide unit 220 is displaced transversely upon being subjected to a force of the pivot arm 232 transmitted from the link 221 via the cam roller 233. As a result, any one of the elevatable blocks 222–224 can be coupled with the air cylinder 210 (see FIG. 7) as shown in FIGS. 7(A)–7(C) and FIGS. 8(A)–8(C) by adequately displacing the slide unit 220.

Right and left limits of the pivoting movement of the pivot arm 232 are defined by the stoppers 239, 240 at a shorter end of the main body 231, and the pivot arm 232 is stopped at a middle position of its pivotal range by a rod 242*a* of an air cylinder 242 (see FIGS. 3 and 6) provided at a side of the switching cylinder 230. The rod 242*a* projects at a specified timing to precisely couple the shank 225 of the elevatable block 223 corresponding to the wire pushing device 260 with the air cylinder 210.

The elevatable block 222 is at one end of the slide block 221, as shown in FIGS. 10 and 11, and has a connection-assisting part in the form of a wire checking device 250. The wire checking device 250 includes a plurality of wire sensors 251 that correspond with the contacts of the insulation-displacement joint connector 20. The wire sensors 251 are carried by a block 252 that is secured by screws 253 to a bottom portion 222*b* of the elevatable block 222. The wire sensors 251 function in a non-contact manner to check the presence of the branch wires W mounted in the housing 22.

Figure 1:
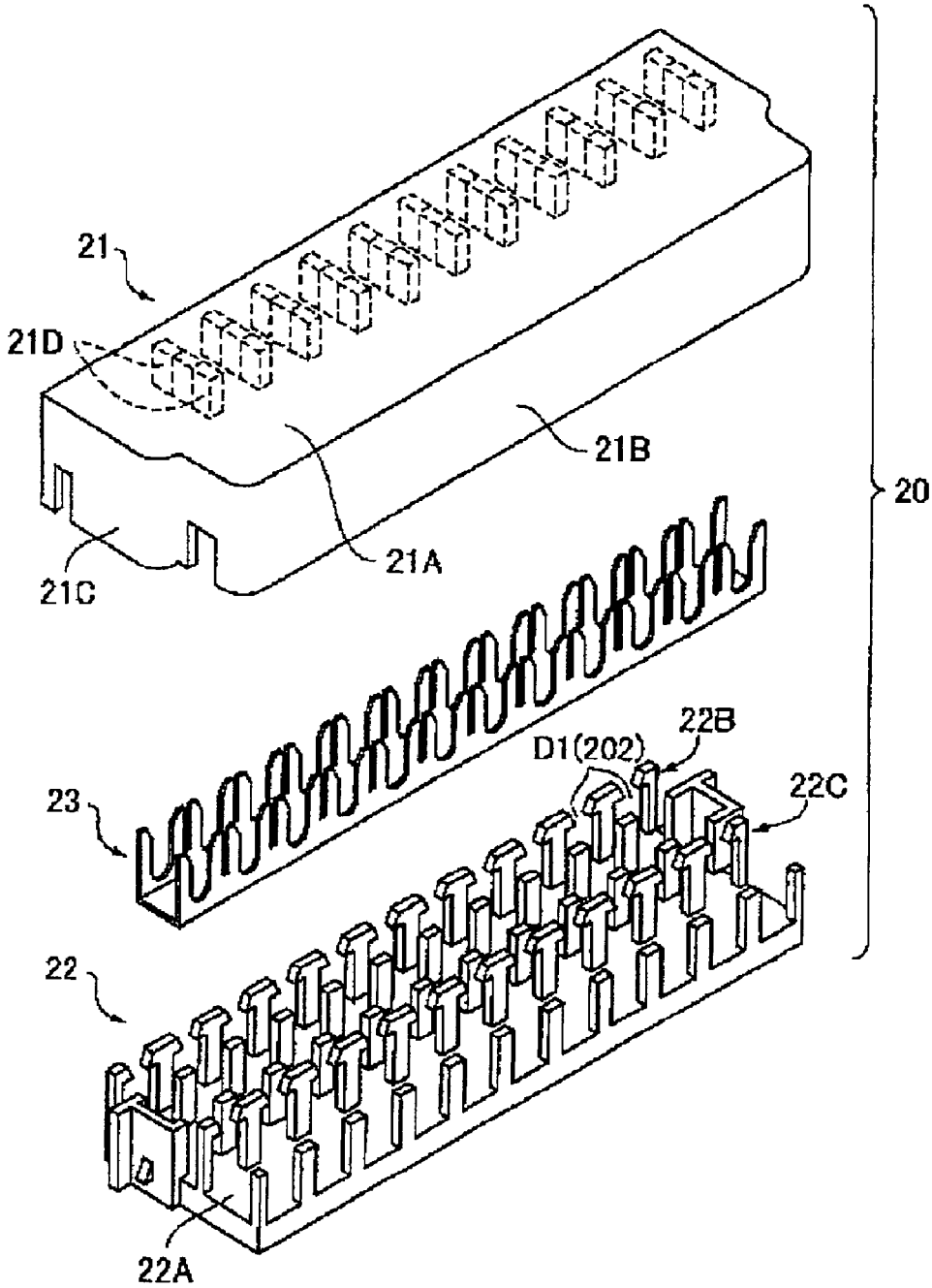
FIG. 1 is an exploded perspective view of an example of an insulation-displacement joint connector to be connected by a connector connecting apparatus according to the invention.

An elevatable plate 254 is provided below the block 252 and is supported for up and down movement by front and rear rods 255, as shown in FIG. 11. Sleeves 256 are fitted atop rods 255, and have larger diameters than the rods 255. The rods 255 are fixed to the bottom of the elevatable block 222. A coil spring 257 is provided between the bottom surface of each sleeve 256 and the elevatable plate 254 to constantly bias the elevatable plate 254 downward or away from the elevatable block 222. The elevatable plate 254 pushes the branch wires W (see FIG. 10) mounted in the housing 22 (see FIG. 1) during the descent of the elevatable block 222, thereby straightening the branch wires W to prevent a failure connection by insulation displacement. Further, at least one opening 254*a* for exposing the respective wire sensors 251 to the wires is formed in the middle of the elevatable plate 254.

Branch wires W that cross or lay one over the other cannot be dealt with only by being pushed by the elevatable plate 254. Thus, the coil springs 257 are set not to be compressed and prevent the elevatable plate 254 from being lowered any further if a reaction force applied to the elevatable plate 254 during the wire pushing operation is larger than a predetermined value.

As shown in FIGS. 10(A) and 10(B), a projection 254*b* for detecting inclination projects at an intermediate position of the elevatable plate 254 with respect to its longitudinal direction and a failure detecting sensor 258 for detecting a failed arrangement of the wires by the inclination of the projection 254*b* is fixed to the bottom portion 222*b*. Thus, if the branch wires W mounted in the housing 22 of the insulation-displacement joint connector 20 should cross or be laid one over the other or misaligned with respect to each other, the elevatable plate 254 cannot be lowered to a proper height as shown in FIG. 10(B). Such a failed wire arrangement is detected by detecting a gap G between the proper height and an actual height of the projection 254*b*.

The wire pushing device 260 includes a block 261 mounted in a recess 223*c* in a bottom portion 223*b* of the elevatable block 223, as shown in FIG. 12. Pushing projections 262 project from the bottom surface of the block 261. The number of the pushing projections 262 corresponds to the number of contacts of the joint connector 20 to be connected. Thus, the pushing projections 262 push the individual branch wires W simultaneously and connect them with the insulation-displacement terminal 23 (see FIG. 1) mounted in the housing 22.

The cover holder 270 includes a main body 271 secured by screws 242 to a bottom portion 224*b* of the elevatable block 224, and an accommodating recess 272 is formed in the bottom surface of the main body 271 for mounting the cover, as shown in FIG. 13. The accommodating recess 272 is formed such that the cover 21 of the insulation-displacement joint connector 20 can be accommodated therein only when properly positioned. Thus, the operator is prevented from erroneously mounting the cover 21. In the shown example, a sensor 224*c* is mounted in the bottom portion 224*b* of the elevatable block 224 for detecting the presence or absence of the cover 21.

With reference to FIG. 2, the air cylinder 210 and the switching cylinder 23 operate upon receiving pressurized air from the pressure intensifying tank 300. The air supply from the pressure intensifying tank 300 is controlled by the control box 310, and the control box 310 is controlled by operating the operation box 320.

The front panel 320*a* of the operation box 320 includes a mode changeover switch 321, a home-position return switch 322, a step-operation switch 323, a reset switch 324, a facility working display switch 325, a confirmation lamp 326, an emergency-stop switch 327, a buzzer 328 as a notifying device, a message number display 329, a wire number input switch 330 and a lower limit display unit 331.

The mode changeover switch 321 is adapted to switch the operation control of the press unit 200 to an automatic operation and a condition setting operation for confirming whether a facility will properly operate.

The home-position return switch 322 is adapted to return the respective elements to their home positions upon power application to the apparatus or upon restarting the press unit 200 after an emergency stop.

The step operation switch 323 is adapted to perform one operation step every time the start switch SW (see FIGS. 2 and 3) is pressed in the case that the automatic mode is selected by the changeover switch 321.

The reset switch 324 is adapted to perform an abnormality processing by canceling a controlled state upon an occurrence of an abnormality.

The facility working display lamp 325 is one example of the display means for displaying that the facility is working.

The confirmation lamp 326 is turned on to notify an operator of an abnormality when an abnormality occurs or the cover is not mounted.

The emergency-stop switch 327 is adapted to forcibly stop the operation of the press unit 200 upon an occurrence of an emergent abnormality.

The buzzer 328 operates as a notification means upon an occurrence of an abnormality or upon completion of the operation to notify the operator of it.

The message number display 329 is a liquid crystal display and is adapted to display an error code numerically upon an occurrence of an abnormality, product numbers in the automatic mode, and the number of wires in the condition-setting mode. Additionally or alternatively, comprehensive error messages may be displayed.

The wire number input switch 330 is adapted to input the number of the wires in the condition-setting mode.

The lower limit display unit 331 is a digital unit with a liquid crystal display 331*a* and an unillustrated operation button. When the operation button is operated, the lower limit positions of the elevatable blocks 222 to 224 when the wire pressing/cover mounting operation is to be performed are displayed and tolerances are or can be inputted.

The operation of the press unit 200 can be controlled as described next by suitably operating the respective switches 321, 322, 323, 324, 327 and 330. The operation box 320 also is electrically connected with the start switches SW and the sensors provided in the respective elements of the press unit 200. Further, a bar code reader 350 is connected with the operation box 320 to respond to a plurality of product numbers. The connecting operation is controlled based on the product number read by the bar code reader 350.

Figure 15:
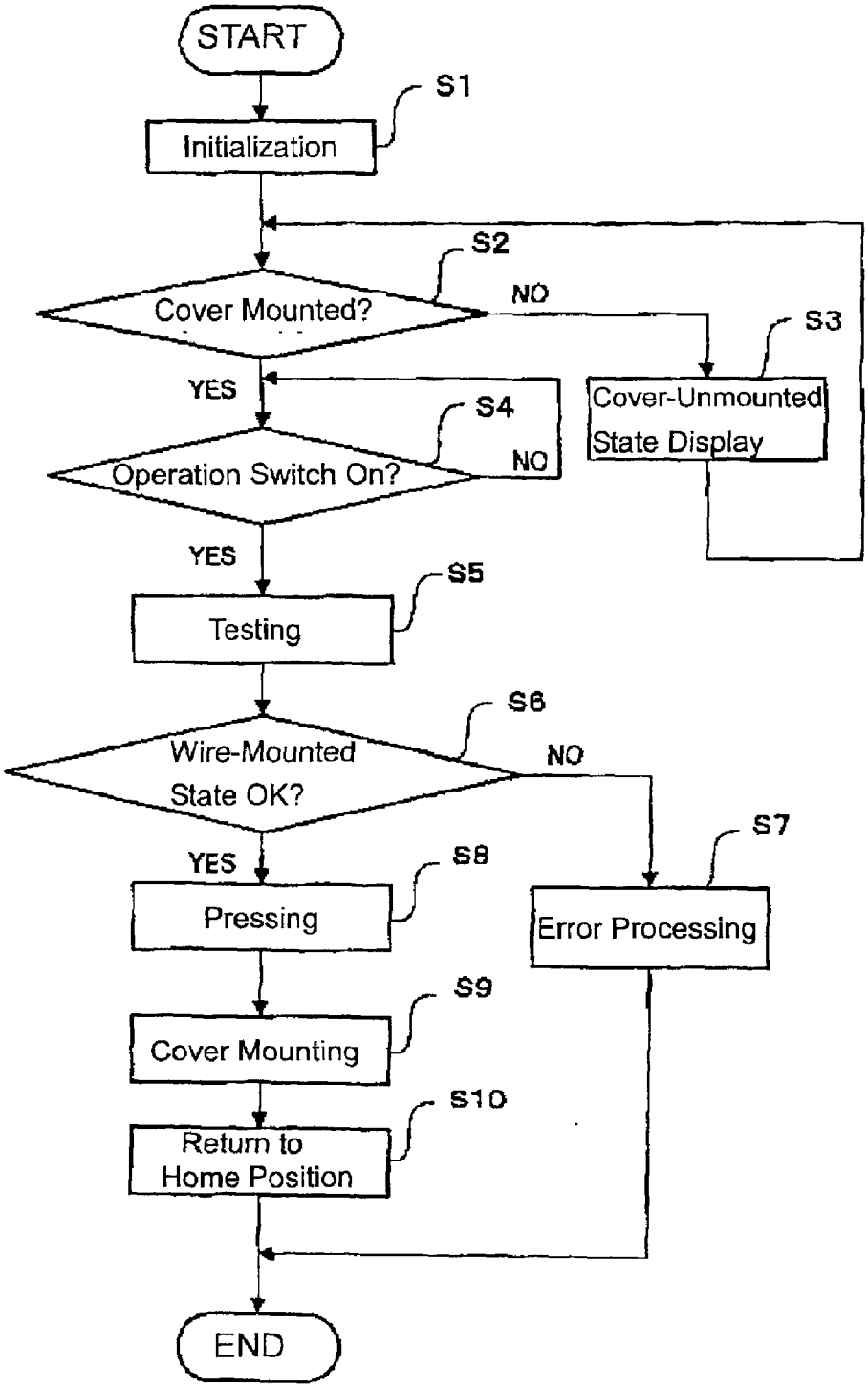
FIG. 15 is a flow chart of an operation procedure according to the embodiment of FIG. 2.

With reference to FIG. 15, initialization is performed in Step S1 in the aforementioned embodiment. Specifically, the mode is set, the lower limit positions are set, conditions are set for each product number, and the product number is specified by reading it preferably by means of the bar code reader 350. In this setting operation, the slide unit 220 is initialized by the switching cylinder 230 and the elevatable block 222 for checking the wires is coupled to the air cylinder 210 as shown in FIGS. 7(A) and 8(A).

The operator initially connects the casing 110 with the conveyed assembling board 1 by engaging the rings 111 of the casing 110 with the locking device 3 of the assembling board 1, as shown in FIG. 2, while holding the grips 121 on the handle arms 120 of the casing 110. Thus, the pressure-receiving table 140 provided in the casing 110 is positioned with respect to a portion of the insulation-displacement joint connector 20 to be connected.

The operator then draws the pressure-receiving table 140 from the pressure-receiving position to the mounting position, mounts the housing 22 of the insulation-displacement joint connector 20 to mount the branch wires W of the wiring harness WH in the housing 22, and returns the pressure-receiving table 140 to the pressure-receiving position (see FIG. 9). The operator also mounts the cover 21 in the cover holder 270 (see FIG. 13) mounted on the elevatable block 224. The connecting apparatus 100 waits on standby until the cover 21 is mounted (Step S2) after the initialization (Step S1). The confirmation lamp 326 (Step S3) indicates a cover-unmounted state if the cover 21 is not detected, and the connecting apparatus 100 will not operate even if the start switch SW is actuated. This prevents the operator from carelessly forgetting to mount the cover 21.

Once the cover has been detected (Step 3), the operator actuates the start switch SW to initiate the checking operation (Steps S4, S5). The checking operation starts by causing the air cylinder 210 to lower the interconnected rod 211, shank 225 and elevatable block 222. This causes the positioning projection 144 to fit into the positioning hole 114*a* of the elevatable block 222, as shown in FIG. 9, thereby positioning the wire checking device 250 and the housing 22 on the pressure-receiving table 140. The gauge dog 228 then is lowered sufficiently to push the switch 229*a* of the lower limit gauge 229. As a result, the elevatable block 222 stops while the lower surface of the bottom portion 222*b* is held in contact with the stopper pins 143, thereby pressing the wire checking device 250 against the housing 22 at a specified substantially uniform pressure.

The elevatable plate 254 presses the wires in a proper position by a biasing force of the coil springs 257, as shown in FIG. 10(A), if the branch wires W are properly mounted in the housing 22 or located only slightly above their properly mounted positions. As a result, the error-detecting sensor 258 detects the orientation of the elevatable plate 254 by the projection 254*b*, and judges whether the wires W are laid properly (step S6). The wire sensor 251 simultaneously detects the presence of the branch wires W, and generates a signal if the branch wires W have been omitted.

The error-detecting sensor 258 will detect the gap G shown in FIG. 10(B) if the elevatable plate 254 cannot be lowered to its proper height due to an improper arrangement of the wires. Thus, the wire-checking device 250 judges a failed wire arrangement (NO in step S6). An error also is judged if the wire sensor 251 cannot detect the branch wires W as specified. Upon judging an error, a control system (microprocessor and the like) in the control box 310 stops the operation (see Step S7) and generates an error signal. This prevents the insulation-displacement joint connector 20 with an improper wire arrangement from being connected with the wire harness WH, thereby improving a yield.

The elevatable block 222 is raised to its initial position after the arranged state of the branch wires W is judged to be proper by the wire checking device 250, and the control enters the wire pressing operation (see Step S8). In this operation, the switching cylinder 230 first moves the slide unit 220 forward by one position to couple the shank 225 of the elevatable block 223 to the flange 212 on the rod 211 of the air cylinder 210, as shown in FIG. 7(B). As described above, this positioning can be performed precisely by causing the rod 242*a* of the air cylinder 242 to project. The elevatable block 223 for pressing the wires then is lowered by the air cylinder 210 in the same manner as described above, and is positioned as in the case of the elevatable block 222 described with reference to FIG. 9. The pushing projections 262 of the wire-pushing device 260 on the elevatable block 223 push the branch wires W into the insulation-displacement terminal 23 mounted in the housing 22. As a result, the coatings of the respective branch wires W are torn or cut and the cores are connected electrically with the insulation-displacement terminal 23 (i.e. connected by insulation displacement).

The elevatable block 223 returns to its original position upon completion of the wire pushing operation, and the control enters the cover mounting operation (Step S9). In the cover mounting operation, the air cylinder 242 (see FIGS. 3 and 6) causes the rod 242*a* to contract and release the pivot arm 232 of the switching cylinder 230. The pivot arm 232 then is rotated forward and moves the slide unit 220 forward into engagement with the elevatable block 224 for mounting the cover, as shown in FIG. 7(C). Subsequently, the air cylinder 210 lowers the elevatable block 224 in the same manner as in the cases of the elevatable blocks 222 and 223, to position and connect the cover 21 and the housing 22.

Upon completion of the cover mounting operation, the respective elements are preferably returned substantially to their home positions (Step S10), thereby completing the connector connecting operation. A more specific example of use may be such that the home-position return switch 322 is operated only once when the power switch is turned on (initialization in Step S1) and the state of the apparatus is returned to the cover mounting standby state (Step S2) from the return to the home positions (Step S10).

As described above, operation steps from checking the wires to mounting the cover can be performed automatically. As a result, errors can be prevented and the yield can be improved. More particularly, the pressure-receiving table 140 and the press unit 200 are incorporated into the common casing 110. With this arrangement, the pressure-receiving table 140 is moved with respect to the press unit 200 from the pressure-receiving position to the mounting position, the branch wires W then are mounted, and the pressure-receiving table 140 is moved back to the pressure-receiving position. Thus, as compared to a case where the pressure-receiving table 140 is on the assembling board 1 for the wiring harness WH, there is no danger of striking the housing 22 of the insulation-displacement joint connector 20 against a member (e.g. casing 110) of the press unit 200 when the pressure-receiving table 140 and the press unit 200 are positioned with respect to each other. Further, the ability to move the pressure-receiving table 140 easily between the mounting position and the pressure-receiving position facilitates the mounting of the housing 22 on the pressure-receiving table 140 and the positioning of the branch wires W in the mounted housing 22.

The air cylinder 210 for moving the shanks 225 and the elevatable blocks 222–224 toward and away from the pressure-receiving table 140 is directly above the pressure-receiving table 140. Additionally, the elevatable blocks 222–224 and the respective connection-assisting parts (wire checking device 250, wire pushing device 260 and cover holder 270) are connectable with the flange 212 of the air cylinder 210 by the operation of the switching device (switching cylinder 230, etc.) for switching an elevating order of the respective connected connection-assisting parts 250, 260, 270. Thus, a plurality of operations can be performed using the same air cylinder 210 as a press, which contributes to a cost reduction for the press unit 200.

The press unit 200 is provided with the air cylinder 210 for moving the flange 212 up and down directly above the pressure-receiving table 140. Additionally, the shanks 225 are detachably attachable to the flange 212 of the air cylinder 210. Thus, the elevatable blocks 222–224 and the respective connection-assisting parts 250, 260, 270 are individually movable up and down. More particularly, the slide unit 220 carries the respective connection-assisting parts 250, 260, 270 via the respective elevatable blocks 222–224, and the switching cylinder 230 selectively couples the shank 225 of the elevatable block 222–224 with the flange 212 of the air cylinder 210 by reciprocally moving the respective connection-assisting parts 250, 260, 270 via the slide unit 220. Thus, it is possible to individually change settings for the elevatable blocks 222–224 for each of the wire checking device 250, the wire pushing device 260 and the cover holder 270 as connection-assisting parts and to set suitable elevation or pressing conditions for each connection-assisting part.

Figure 16:
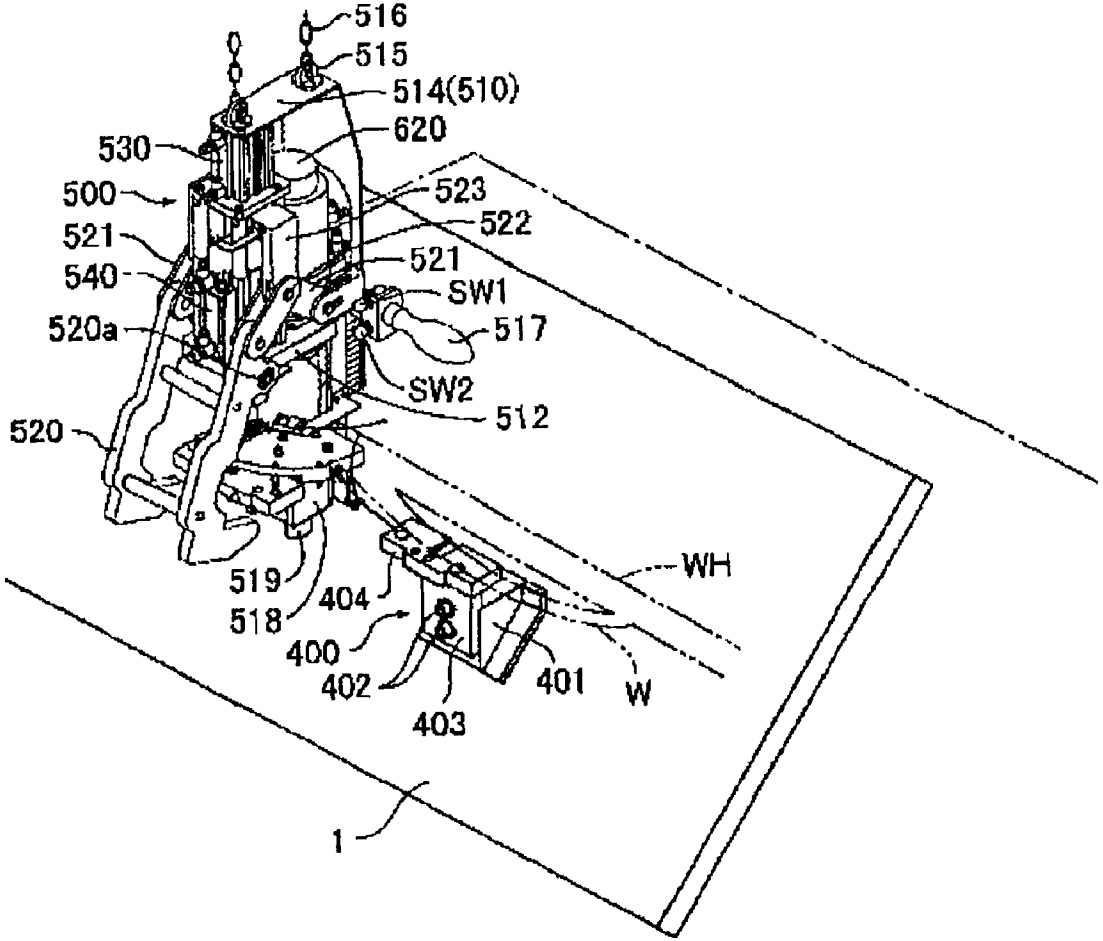
FIG. 16 is a perspective view showing a schematic construction of another embodiment of the invention.
Figure 17:
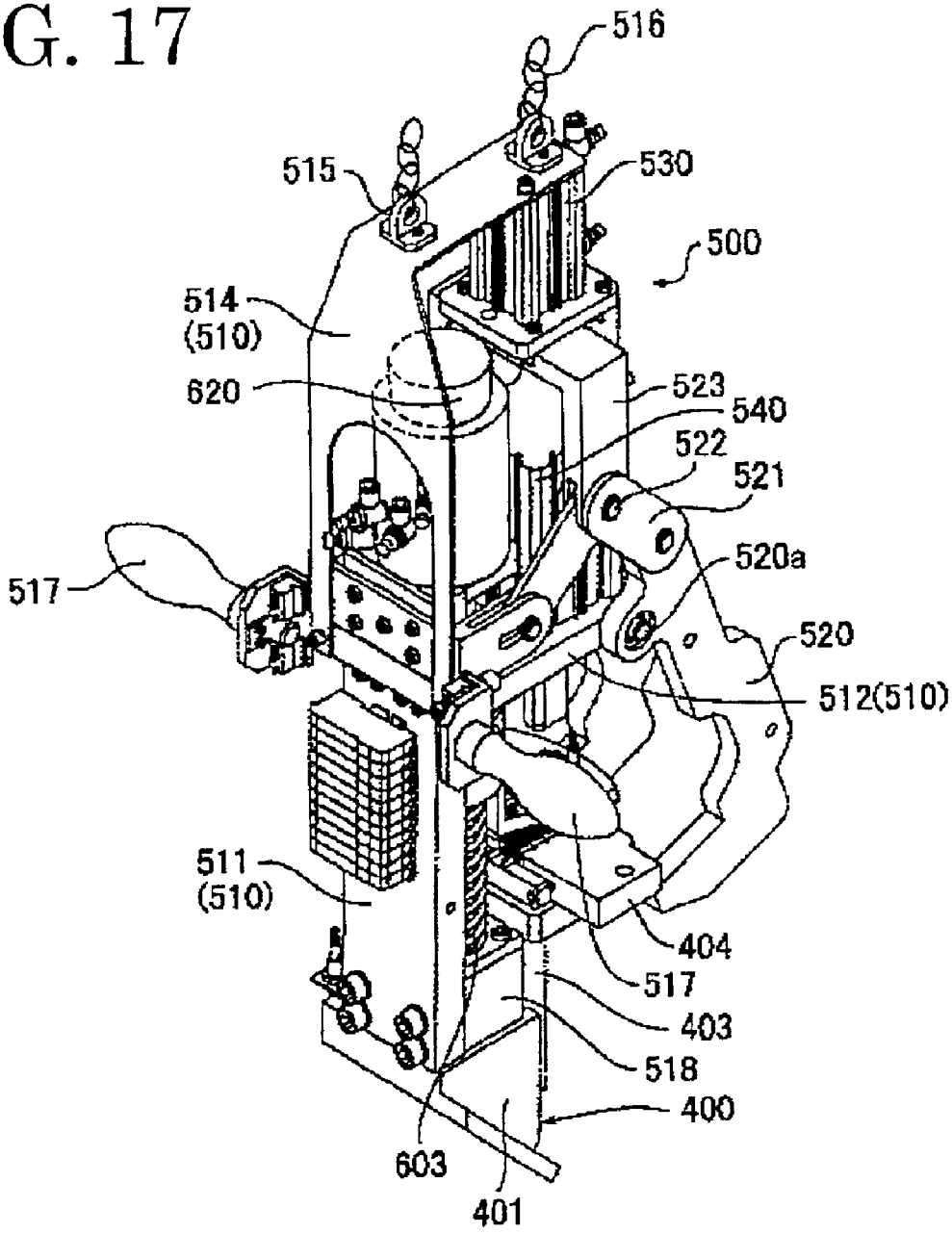
FIG. 17 is a perspective view showing a schematic construction of a press portion according to the embodiment of FIG. 16 when viewed from behind.

An alternate embodiment is shown in FIGS. 16 to 24, and is particularly preferable for assembling boards 1 that are fixed. More particularly, an alternate pressure-receiving table 400 is separated from a press unit 500 and is fixed to each assembling board, as shown in FIGS. 16 and 17. This embodiment is particularly preferable for assembling boards 1 that are fixed.

Figure 18:
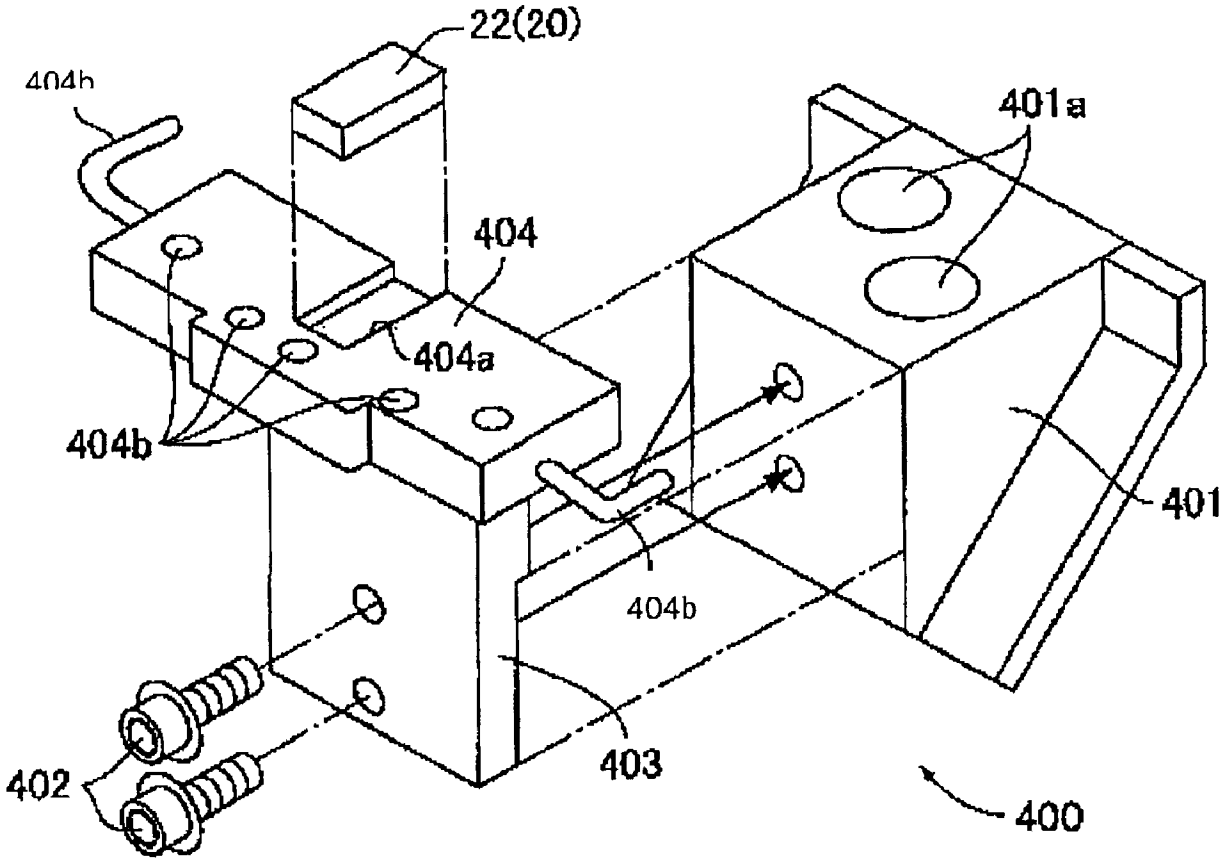
FIG. 18 is an exploded perspective view of a pressure-receiving table according to the embodiment of FIG. 16.

The pressure-receiving table 400 is provided with a mounting block 401 secured to the assembling board 1, a table member 403 secured to the mounting block 401 by screws 402, and a pressure-receiving plate 404 integrally or unitarily formed atop the table member 403, as shown in FIGS. 16 and 18. The housing 22 can be held detachably in an accommodating recess 404*a* formed in the upper surface of the pressure-receiving plate 404. The pressure-receiving plate 404 is formed with positioning holes 404*c*. Further, L-shaped wire catchers 404*b* are provided at opposite sides of the pressure-receiving plate 404.

With reference to FIGS. 16 and 17, the press unit 500 has a casing 510, a coupling arm 520 for coupling the casing 510 with the pressure-receiving table 400, an arm driving cylinder 530 for driving the coupling arm 520 and an air cylinder 540 as a press corresponding to the air cylinder 210 of the embodiment of FIG. 2.

The casing 510 is integrally or unitarily formed with a vertically extending back plate 511, a shelf plate 512 cantilevered forwardly from the top of the back plate 511, and an L-shaped suspended plate 514 secured to the rear of the shelf plate 512. Chains 516 are coupled with mount fittings 515 at the top of the suspended plate 514 and suspend the entire press unit 500 for up and down movement e.g. from the ceiling.

The coupling arm 520 has an intermediate portion that is rotatably supported on the front side of the shelf plate 512 of the casing 510 by a shaft 520*a*, and has base end pivotally coupled to the casing 510 via a link 521. The link 521 has a joint 522 that is coupled to the arm-driving cylinder 530 via a coupling portion 523. Thus, the coupling arm 520 can pivot about a transverse axis to move its free end forward and backward for selective engagement with the rear surface of the pressure-receiving plate 404 of the pressure-receiving table 400 with the block 518 seated on the mounting block 401. As a result, the entire press unit 500 can be engaged with the pressure-receiving table 400.

Handles 517 project from the opposite sides of the casing 510. Arm switches SW1 for actuating the arm driving cylinder 530 and press switches SW2 for actuating the air cylinder 540 are provided near the handles 517 (only one side is shown in FIG. 16). The block 518 is provided at the bottom end of the front surface of the back plate 511.

Figure 19:
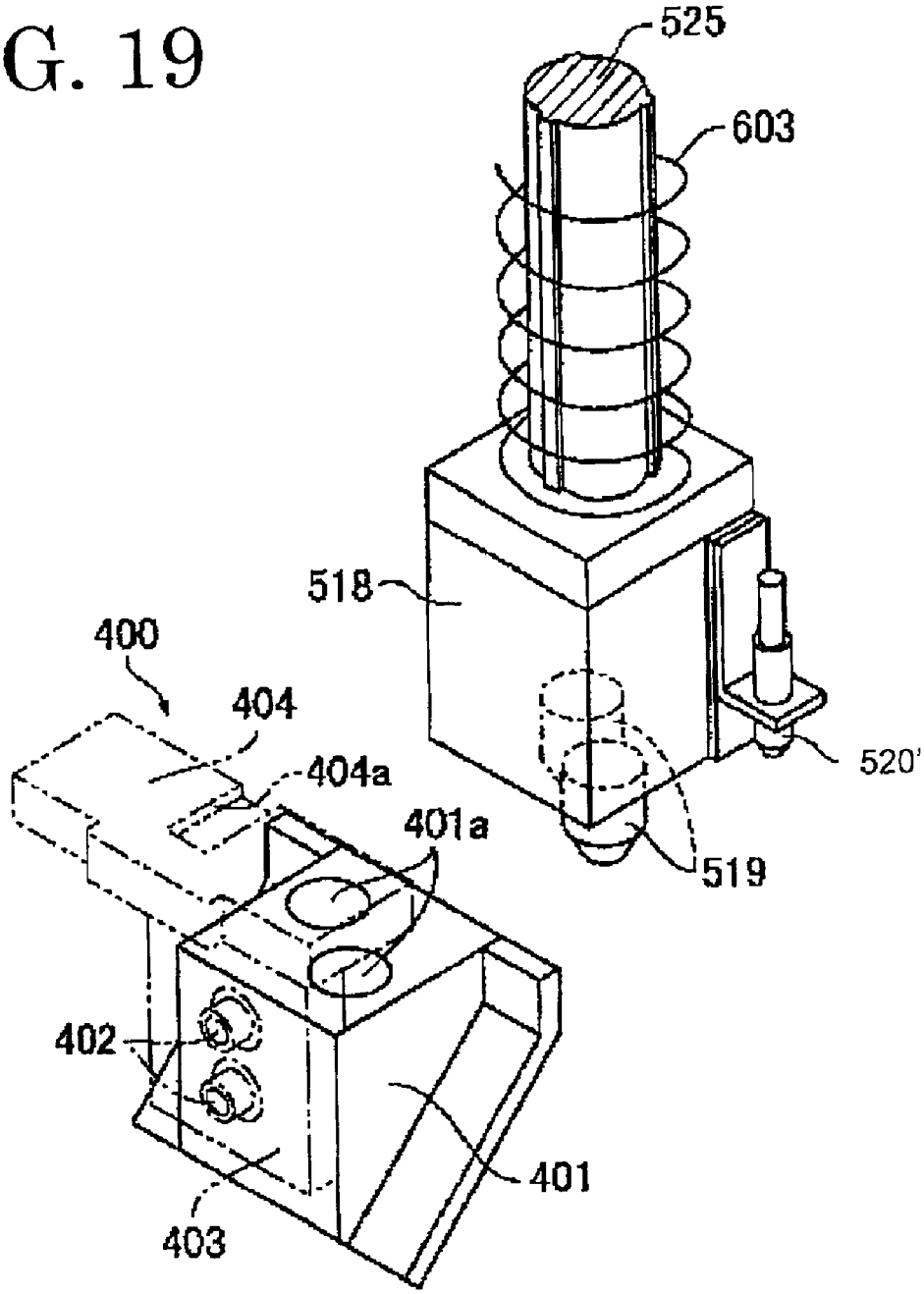
FIG. 19 is a simplified perspective view showing a portion of the press unit according to the embodiment of FIG. 16.

Two positioning projections 519 are provided on the bottom of the block 518, as shown in FIG. 19, whereas the mounting block 401 of the pressure-receiving table 400 is formed with fitting holes 401*a* that correspond to the positioning projections 519. Connection-assisting parts 450, 460, 470 (FIGS. 20–22) similar to the wire checking device 250, the wire pushing device 260 and the cover holder 270 in the FIG. 2 embodiment of can be positioned precisely with respect to the housing 22 mounted on the pressure-receiving table 400 by placing the block 518 on the upper surface of the mounting block 401 while inserting the positioning projections 519 into the fitting holes 401*a* (see FIG. 17).

A sensor 520' is provided at one side of the block 518 for detecting that the block 518 is seated correctly on the mounting block 401. The sensor 520' serves as a safety switch for the arm switches SW1. Thus, the arm driving cylinder cannot be actuated if the sensor 520' does not detect a seated state of the block 518, and the coupling arm 520 will not be actuated even if an operator actuates the arm switches SW1. The arm switches SW1 comprise self-hold circuits so that the coupling arm 520 is locked in its coupled state until a specified operation is completed, even if the operator actuates the arm switches SW1.

A substantially spline-shaped support shaft 525 rotatably stands on the block 518 via an unillustrated bearing, and a rotatable unit 600 is provided on the support shaft 525.

Figure 20:
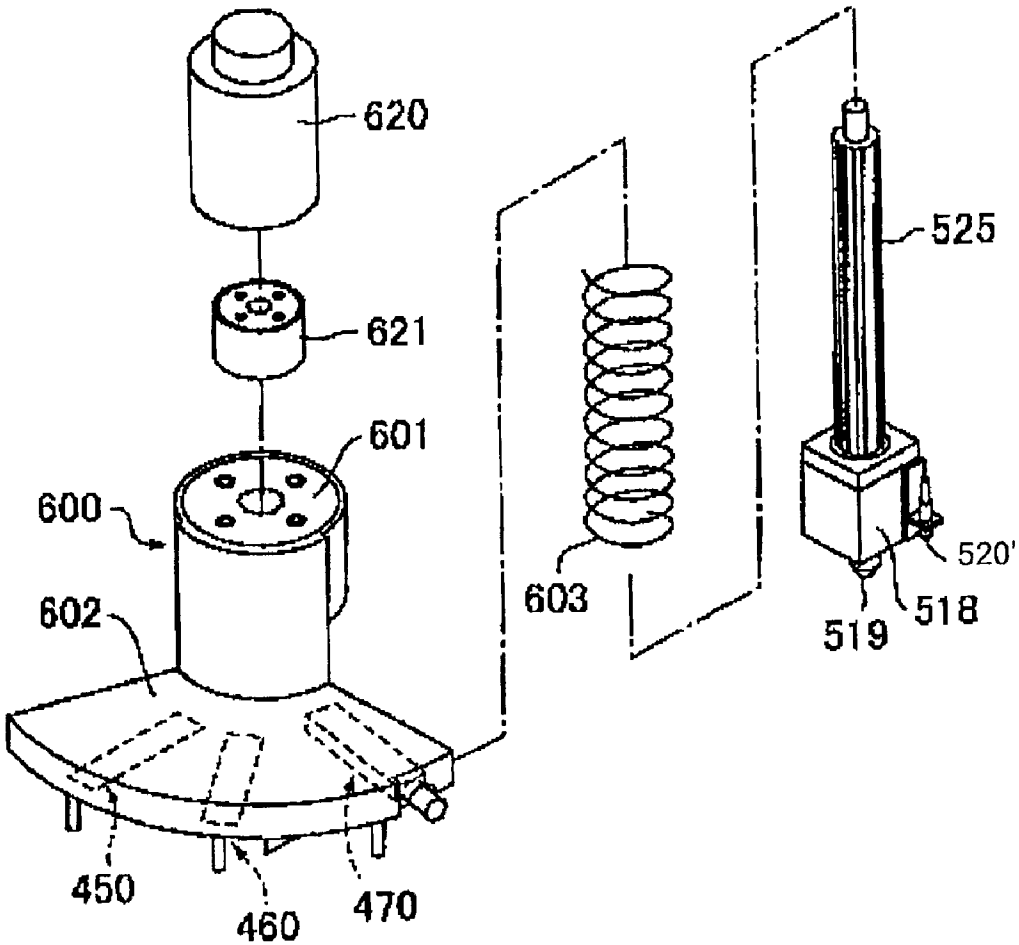
FIG. 20 is an exploded perspective view showing a construction of a rotatable unit according to the embodiment of FIG. 16.

The rotatable unit 600 includes a sleeve 601 slidably fit to the support shaft 525 for movement only in the axial direction, and a substantially fan-shaped rotatable plate 602 is below the sleeve 601, as shown in FIGS. 19 and 20. The connection-assisting parts 450, 460 and 470, similar to the connection-assisting parts 250, 260 and 270 of the FIG. 2 embodiment, are mounted on the lower surface of the rotatable plate 602, which is the surface facing the pressure receiving table 400. Positioning projections 602*a* project down from the lower surface of the rotatable plate 602. The housing 22 on the pressure-receiving plate 404 is positioned with respect to the connection-assisting part 450, 460 or 470 on the rotatable plate 602 by fitting the corresponding positioning projections 602*a* into the positioning holes 404*c* of the pressure-receiving plate 404 in each of the respective positions to be described later.

A coil spring 603 is mounted on the support shaft 525 between the rotatable unit 600 and the block 518. Thus, the rotatable unit 600 is coupled to the support shaft 525 for elastic or resilient movement up and down along the longitudinal direction of the support shaft 525. The support shaft 525 is rotatably supported on the block 518. Thus, the rotatable unit 600 can be rotated in both directions about the longitudinal axis of the support shaft 525.

A rotary actuator 620 is mounted on the casing 510 to rotate the rotatable unit 600, and the support shaft 525 is coupled thereto via a coupling 621. The rotary actuator 620 is adapted to move the rotatable unit 600 reciprocally along the circumferential direction and to rotate it intermittently about the support shaft 525 at an interval of, e.g. 60°. The connection-assisting parts 450, 460 and 470 are arranged substantially equally to conform to this rotation interval, so that they can stop at a predetermined pressing position.

Figure 21:
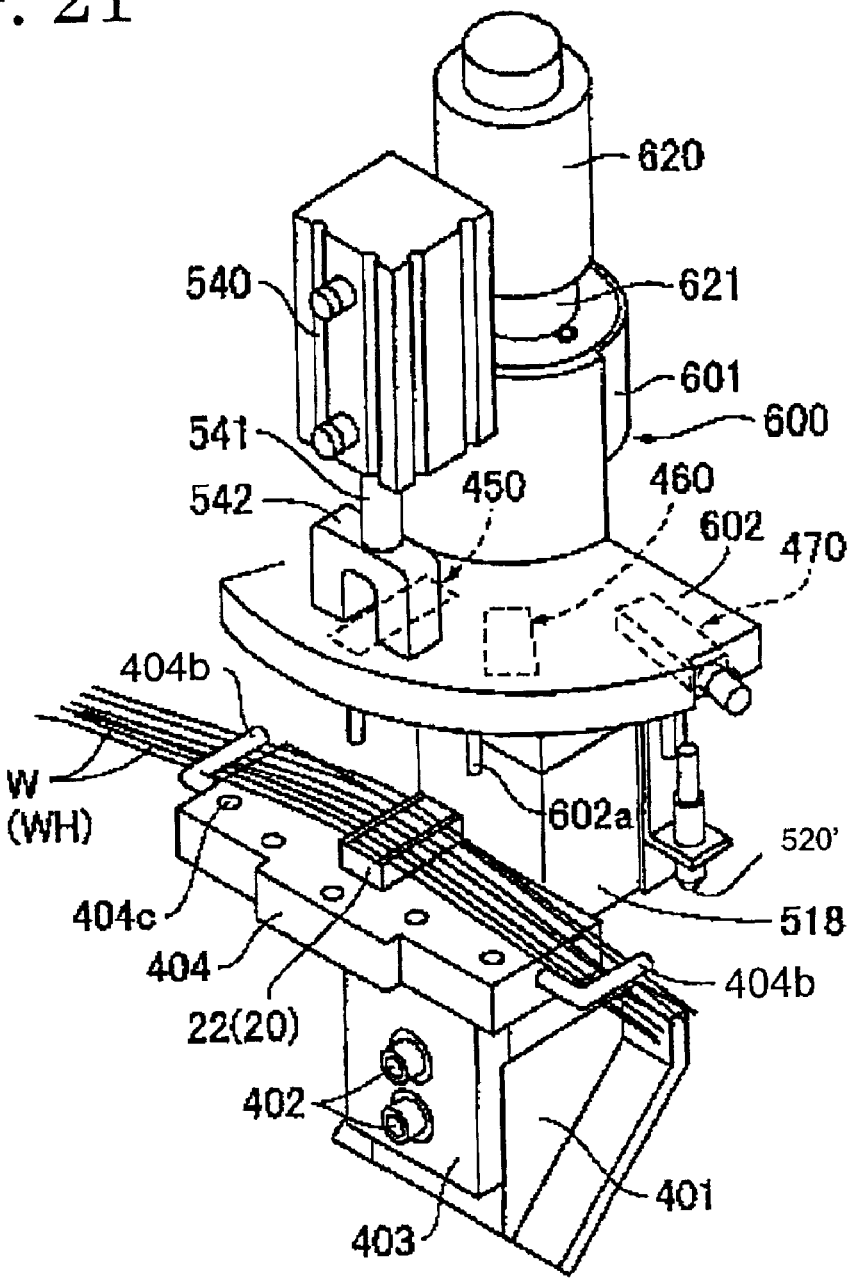
FIG. 21 is a perspective view showing a press mechanism according to the embodiment of FIG. 16.

As shown in FIG. 21, the pressing position is set such that, the air cylinder 540 carried on the casing 510 is located substantially right above the pressure-receiving plate 404 when the block 518 is aligned with the mounting block 401 of the pressure-receiving table 400. The air cylinder 540 has a rod 541 that can move up and down, and a substantially arch-shaped pressing element 542 is fixed to the bottom end of the rod 541. The rod 541 can be moved down at the pressing position to press the rotatable plate 602 of the rotatable unit 600 from above. Thus, the connection-assisting part 450 (460, 470) mounted on the lower surface of the rotatable plate 602 can be pressed against the housing 22 on the pressure-receiving table 404. The rotatable plate 602 is positioned during its ascent and descent by the positioning hole 404*c* in the upper surface of the pressure-receiving table 404 and the positioning projections 602*a* extending from the lower surface of the rotatable plate 602.

The press unit 500 also is provided with the driving device (pressure intensifying tank 300) and the drive controlling means (control box 310 and operation box 320) described with respect to FIG. 2, which can cause the press unit 500 to operate as follows. With reference to FIG. 16, in the above construction, the operator first places the housing 22 on the pressure-receiving plate 404 of the pressure-receiving table 400 and mounts the cover 21 into the cover holder 470 as one of the connection-assisting parts of the press unit 500.

The operator then moves the suspended casing 510 by gripping the handles 517 with both hands, and fits the positioning projections 519 of the block 518 into the fitting holes 401*a* of the mounting block 401 on the pressure-receiving table 400 of the assembling board 1. This causes the sensor 520 to detect the correct seated state of the block 518, and makes the arm switches SW1 operable.

The operator then actuates the arm switch SW1. As a result, the arm driving cylinder 530 lowers the coupling portion 523 to engage the free end of the coupling arm 520 with the rear surface of the pressure-receiving plate 404 of the pressure-receiving table 400, thereby lockingly engaging the press unit 500 with the pressure-receiving table 400. An unillustrated control system is programmed to confirm whether the cover 21 is mounted as the coupling arm 520 is coupled. If the cover 21 is not detected, the cover-unmounted state display is made, as in the case described with reference to the flow chart for the FIG. 2 embodiment, and the next operation step does not follow until a properly mounted cover 21 is detected (see Steps S2, S3 of FIG. 15).

The operator next actuates the press switch SW2, and operations of Steps S5 to S10 of FIG. 15 are carried out automatically to perform the wire checking operation, the wire pushing operation and the cover mounting operation.

Figure 22:
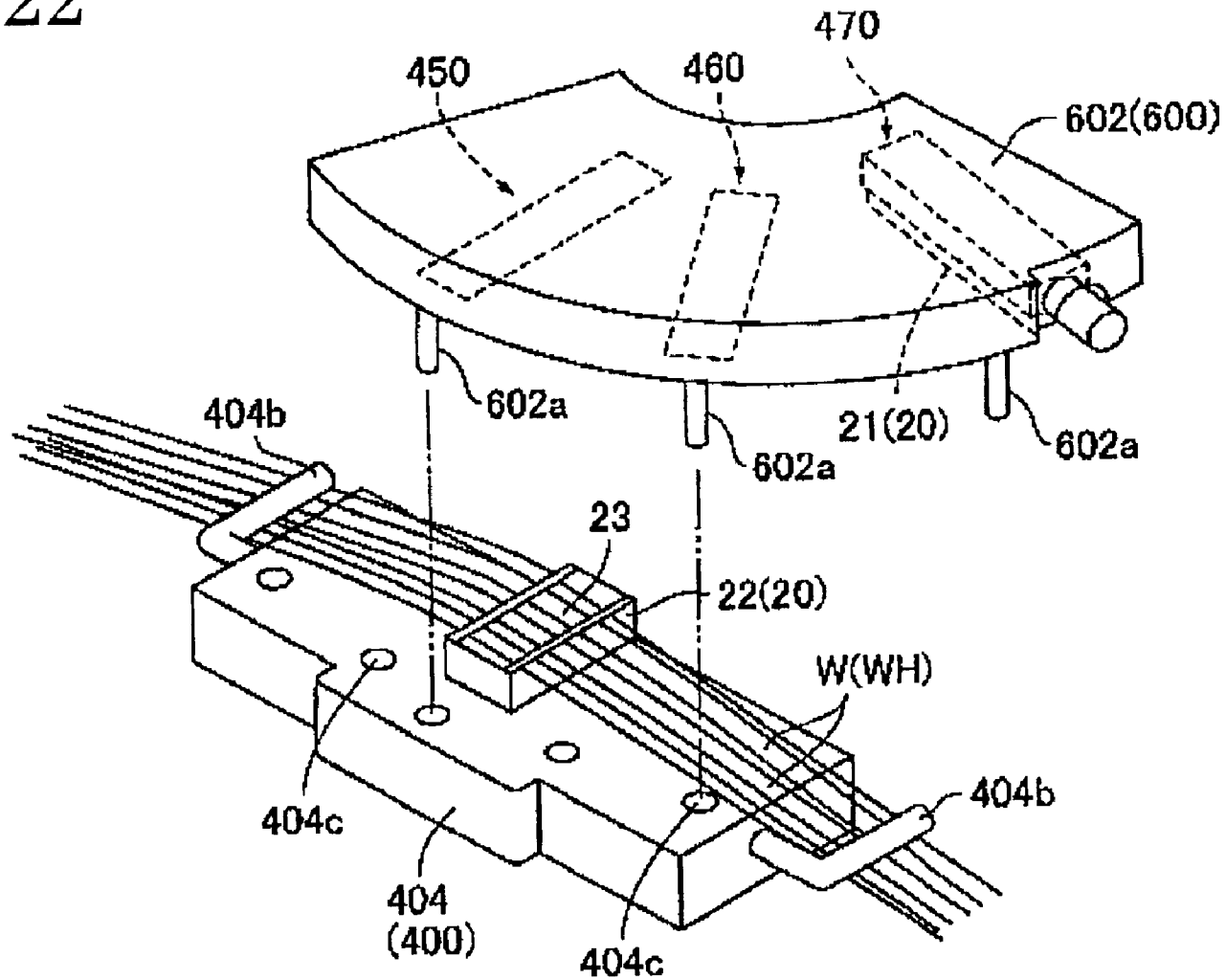
FIG. 22 is a perspective view showing a phase of the rotatable or pivotable unit during a wire checking operation according to the embodiment of FIG. 16.
Figure 23:
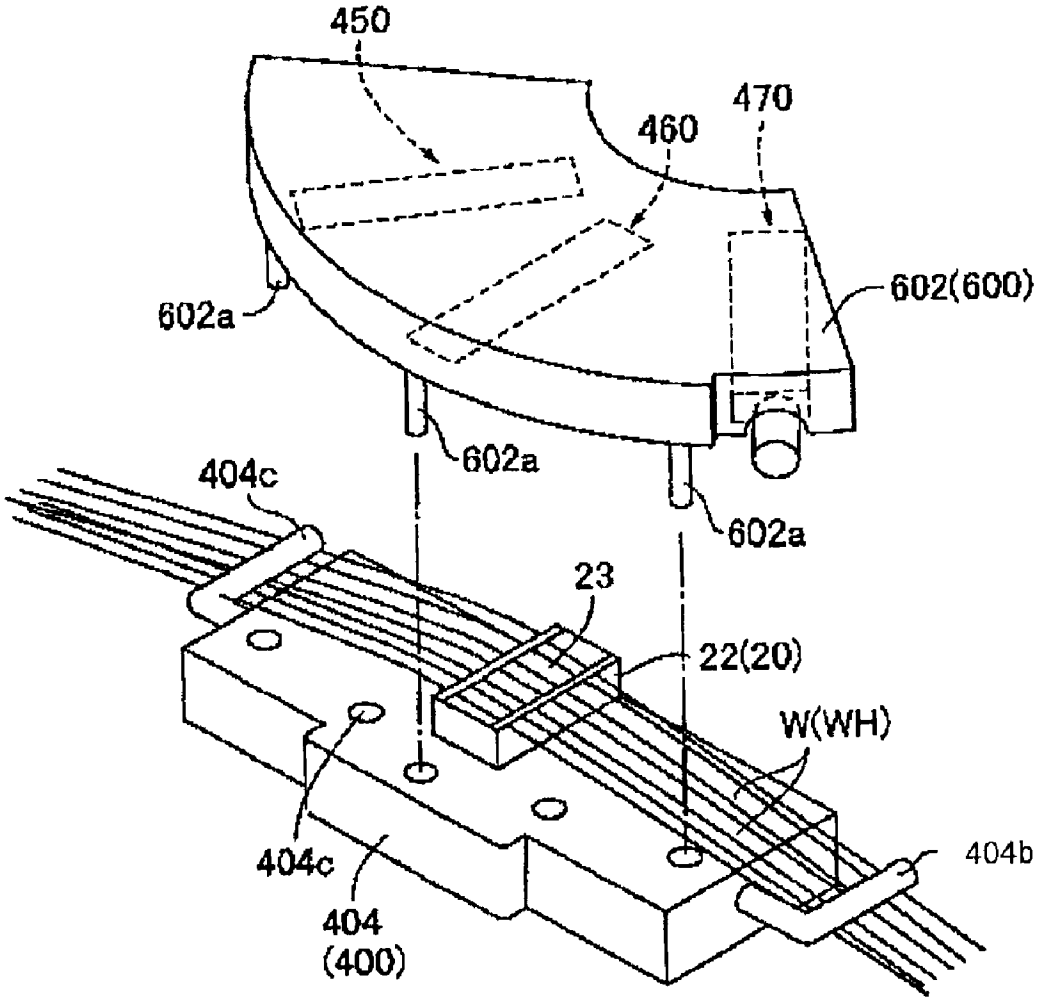
FIG. 23 is a perspective view showing a phase of the rotatable or pivotable unit during a wire pushing operation according to the embodiment of FIG. 16.

The phase of the rotatable plate 602 of the rotatable unit 600 is set, as shown in FIGS. 21 and 22, so that the wire-checking device 450 is at the pressing position during the wire checking operation. In this state, the air cylinder 540 causes the rod 541 to lower the pressing element 542 and push the rotatable plate 602 down. In this way, a wire checking operation similar to Steps S5 to S7 of FIG. 15 can be performed.

The air cylinder 540 causes the rod 541 to contract upon completion of the wire checking operation, and the rotatable unit 600 is moved up by the biasing force of the coil spring 603 (see FIG. 20) that supports the rotatable unit 600. The rotary actuator 620 then moves the rotatable unit 600 forward by one position to bring the wire pushing device 460 to the pressing position. Thereafter, the wire pushing operation can be performed by repeating the pressing operation.

Figure 24:
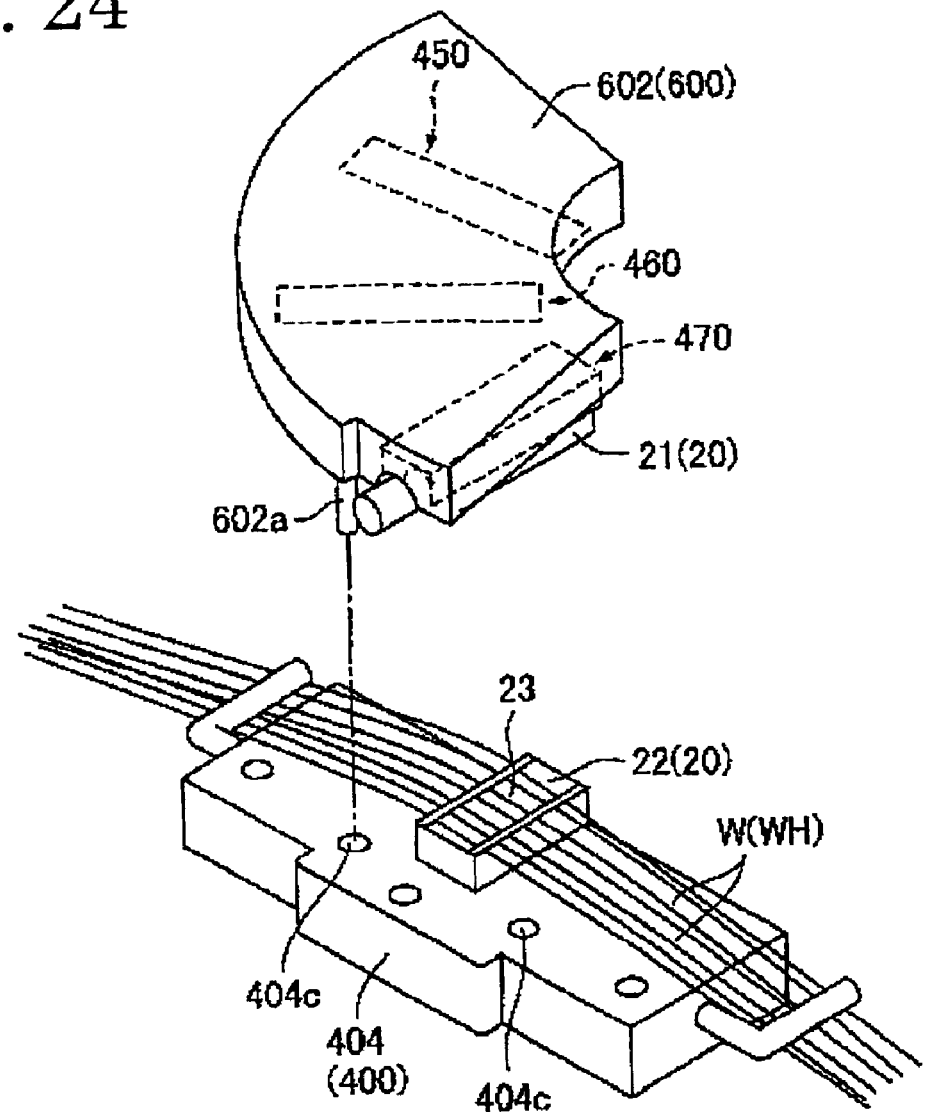
FIG. 24 is a perspective view showing a phase of the rotatable or pivotable unit during a cover mounting operation according to the embodiment of FIG. 16.

With reference to FIGS. 22 and 24, the rotatable unit 600 is moved up after completion of the wire pushing operation, and the rotary actuator 620 moves the rotatable unit 600 forward by one position to bring the cover holder 470 to the pressing position. Thereafter, the cover mounting operation can be performed by repeating the pressing operation.

The rotatable unit 600 is moved up or away from the pressure receiving table 400 after completion of the cover mounting operation, and the rotary actuator 620 rotates the rotatable unit 600 back until the wire checking device 450 is returned to the pressing position. The locked state of the arm switches SW1 is canceled upon completion of the returning movement of the rotatable unit 600, and the operator operates the arm switch SW1 again to disengage the coupling arm 520 from the pressure-receiving plate 404 of the pressure-receiving table 400. Thereafter, the operator detaches the press unit 500 from the pressure-receiving table 400 by gripping the handles 517 to complete the operation.

The operation from the wire-checking step to the cover mounting step can be performed automatically and errors can be prevented by the wire checking device and the like. Therefore, a yield can be improved.

Further, a plurality of connection-assisting parts (wire checking device, wire pushing device 460 and cover holder 470) are provided on the rotatable unit 600 directly above the pressure-receiving table 400, and the same air cylinder 540 is commonly used as the press. Therefore, the press unit is less expensive.

The aforementioned embodiments are merely preferable specific examples of the present invention, and the present invention is not limited thereto.

For example, a positioning pin may stand on the pressure-receiving table 404, and a corresponding positioning hole may be formed in the lower surface of the rotatable plate 602 in the embodiment shown in FIGS. 16 to 24.

It should be appreciated that various other design changes can be made without departing the scope of the present invention as claimed.

As described above, the operation from the wire checking step to the cover mounting step can be performed automatically and a yield can be As described above, the operation from the wire checking step to the cover mounting step can be performed automatically and a yield can be improved since errors can be prevented by the wire checking device and the like. Thus, the present invention can provide remarkable effects of a higher yield even for insulation-displacement joint connectors having many contacts and an efficient performance of the connecting operation by insulation displacement and the cover mounting operation.

What is claimed is:

1. An insulation-displacement connector connecting apparatus for connecting an insulation-displacement connector having a housing, at least one insulation-displacement terminal mounted in the housing and configured for connection with a plurality of wires, and a cover to be mounted on the housing, comprising:

a pressure-receiving table for at least partly receiving the housing with the insulation-displacement terminal mounted therein;

a press unit comprising, as connection-assisting parts, a wire pushing device configured for directly engaging and pushing the wires mounted in the housing on the pressure-receiving table along a pushing axis and into the insulation-displacement terminal mounted in the housing and a cover holder offset transversely from the wire pushing device relative to the pushing axis and configured for holding the cover of the insulation-displacement connector to mount the cover on the housing after the wires are pushed into the insulation-displacement terminal, the press unit further comprising means for moving the connection-assisting parts transverse to the pushing axis for selectively aligning one of the wire pushing devices and the cover holder with the pushing axis and for subsequently pressing the respective connection-assisting parts toward the pressure-receiving table; and a drive controlling means for controllably driving the connection assisting parts transverse to the pushing axis and controllably driving the press unit along the pushing axis so as to sequentially press the wire pushing device and the cover holder.

2. An insulation-displacement connector connecting apparatus according to claim 1, wherein the press unit further comprises, as a connection-assisting part, a wire checking device for checking the wires before the wires are pushed by the wire pushing device, and the drive controlling means comprises a discriminating portion for judging whether a state of the wires is satisfactory when the wire checking device of the press unit is driven, the driving control means permitting the press unit to drive the wire pushing device and the cover holder if the discriminating portion judges that the state of the wires is satisfactory and hinders the operation of the press unit if the discriminating portion judges that the state of the wires is unsatisfactory.

3. An insulation-displacement connector connecting apparatus according to claim 1, wherein the pressure-receiving table is movable with respect to a casing of the press unit between a mounting position where the wires can be mounted and a pressure-receiving position where the pressure-receiving table receives pressure from the press unit.

4. An insulation-displacement connector connecting apparatus according to claim 1, wherein the press unit comprises:

a press substantially directly above the pressure-receiving table for performing a pressing operation, a reciprocally movable unit for carrying the connection-assisting parts and reciprocally movable within a range of a specified stroke, a switching device for switching the respective connection-assisting parts to a pressing position in the press via the reciprocally movable unit in an order of the wire pushing device and the cover holder, and a transmitting means for transmitting a driving force of the press to the connection-assisting part at the pressing position.

5. An insulation-displacement connector connecting apparatus according to claim 4, wherein the reciprocally movable unit comprises a shank detachably mountable on a shank holder of the press, and an elevatable block for each of the connection-assisting parts and being individually movable towards and away from the pressure-receiving table.

6. An insulation-displacement connector connecting apparatus according to claim 4, wherein the reciprocally movable unit comprises an elevatable plate adapted to carry the respective connection-assisting parts and being directly driven by the press to move towards and away from the pressure-receiving table.

7. An insulation-displacement connector connecting apparatus according to claim 6, wherein the press unit is releasably mounted to the pressure-receiving table fixedly mounted on a wire assembling board.

8. An insulation-displacement connector connecting apparatus according to claim 1, wherein the pressure-receiving table and the press unit are positioned with respect to each other by means of at least one pin provided on one of the pressure-receiving table and the press unit and by a corresponding recess provided on the other of the pressure-receiving table and the press unit.

9. An insulation-displacement connector connecting apparatus for connecting an insulation-displacement connector having a housing, at least one insulation-displacement terminal mounted in the housing and configured for connection with a plurality of wires, and a cover to be mounted on the housing, comprising:

a press movable along a first axis for performing a pressing operation;

a pressure-receiving table having a housing-receiving portion configured for receiving the housing with the insulation-displacement terminal mounted therein, the pressure-receiving table being disposed such that the housing-receiving portion is substantially aligned with the first axis;

a plurality of connection assisting parts that are different from one another, one of said different connection assisting parts being disposed substantially on said first axis and between the pressure-receiving table and the press; and a reciprocally movable unit connected to the different connection-assisting parts and operative for moving the different connection assisting parts along a second axis substantially perpendicular to said first axis for positioning selective ones of said different connection assisting parts in line with the first axis for performing different specified connection assisting functions on the housing and the insulation-displacement terminal on the pressure receiving table.

10. The insulation-displacement connector connecting apparatus of claim 9, wherein the pressure-receiving table is selectively movable along a third axis substantially perpendicular to said first and second axes from a mounting position where the housing-receiving portion is offset from said first axis and a pressure-receiving position where said housing-receiving portion is aligned with said first axis.

11. The insulation-displacement connector connecting apparatus of claim 9, wherein the connection-assisting parts comprise a wire pushing device configured for directly engaging and pushing the wires into the insulation-displacement terminal mounted in the housing on the pressure-receiving table.

12. The insulation-displacement connector connecting apparatus of claim 11, wherein the connection-assisting parts further comprise a cover holder for holding the cover of the insulation-displacement connector and mounting the cover on the housing after the wires are pushed into the insulation-displacement terminal.

13. The insulation-displacement connector connecting apparatus of claim 12, wherein the connection-assisting parts further comprise a wire checking device for checking the wires before the wires are pushed by the wire pushing device, and the drive controlling means comprises a discriminating portion for judging whether a state of the wires is satisfactory when the wire checking device of the press unit is driven, the driving control means permitting the press unit to drive the wire pushing device and the cover holder if the discriminating portion judges that the state of the wires is satisfactory and hinders the operation of the press unit if the discriminating portion judges that the state of the wires is unsatisfactory.

* * * * *

UNITED STATES PATENT AND TRADEMARK OFFICE

CERTIFICATE OF CORRECTION

PATENT NO. : 6,931,719 B2
DATED : August 23, 2005
INVENTOR(S) : Itai et al.

It is certified that error appears in the above-identified patent and that said Letters Patent is hereby corrected as shown below:

Title page,
Item [75], Inventors, replace "Toshi" with -- Toshio --.

Signed and Sealed this

First Day of November, 2005

JON W. DUDAS
*Director of the United States Patent and Trademark Office*